US007252361B2

(12) United States Patent
Nishikawa et al.

(10) Patent No.: US 7,252,361 B2
(45) Date of Patent: Aug. 7, 2007

(54) INK JET RECORDING APPARATUS HAVING AN INK ABSORBING MEMBER AND A WIPING MEMBER

(75) Inventors: Katsumasa Nishikawa, Tokyo (JP); Yasushi Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 10/876,465

(22) Filed: Jun. 28, 2004

(65) Prior Publication Data

US 2005/0007412 A1 Jan. 13, 2005

(30) Foreign Application Priority Data

Jul. 1, 2003 (JP) ..... 2003-189234

(51) Int. Cl.
*B41J 2/165* (2006.01)

(52) U.S. Cl. ..... 347/22; 347/31; 347/32; 347/33

(58) Field of Classification Search ..... 347/22, 347/29–34, 20; 400/701, 702, 702.1
See application file for complete search history.

(56) References Cited

U.S. PATENT DOCUMENTS 6,460,967 B1 * 10/2002 Makita et al. ..... 347/33
6,532,025 B1 3/2003 Hiramatsu ..... 347/29
6,913,339 B2 * 7/2005 Uchida et al. ..... 347/29

FOREIGN PATENT DOCUMENTS

JP 4-65248 * 3/1992
JP 2001-63074 3/2001
JP 2002-361879 * 12/2002

* cited by examiner

*Primary Examiner*—Juanita D. Stephens
(74) *Attorney, Agent, or Firm*—Fitzpatrick, Cella, Harper & Scinto

(57) ABSTRACT

An apparatus is capable of securely cleaning foreign matter, such as ink, attached to a discharge port surface with good efficiency, even in the case of a broad discharge port surface such as in a full-line type apparatus, and capable of preventing a discharge defect of the ink or deviation in a discharge direction, so as to perform satisfactory recording. The apparatus includes: an absorbing roller, formed of a rotatable roller-shaped porous absorbing material, for wiping/removing foreign matter, such as ink, attached to a discharge port surface, and wipers, formed of plate-shaped rubber-like elastic materials, for sweeping/removing the foreign matter attached to the discharge port surface. The absorbing roller is moved ahead when both the absorbing roller and the wiper are brought into contact with the discharge port surface and moved in an arrangement direction of discharge ports along the discharge port surface.

8 Claims, 20 Drawing Sheets

INK JET RECORDING APPARATUS HAVING AN INK ABSORBING MEMBER AND A WIPING MEMBER

This application claims priority from Japanese Patent Application No. 2003-189234 filed on Jul. 1, 2003, which is hereby incorporated by reference.

BACKGROUND OF THE INVENTION

1. Field of the Invention

The present invention relates to an ink jet recording apparatus which discharges ink to a material to be recorded from recording means, particularly to an ink jet recording apparatus including means for cleaning a discharge port surface to remove foreign particles such as ink and dust sticking to the discharge port surface of recording means.

2. Related Background Art

In an ink jet recording apparatus, ink droplets are flied to a material to be recorded from a discharge port of recording means to perform recording. Therefore, during a recording operation, ink mist accompanying the flied ink droplets, ink mist bounced back from the material to be recorded or the like sometimes sticks to a discharge port surface. Moreover, when ink droplets, water droplets, dust and the like generated at an ink discharge time stick to the discharge port surface, they sometimes obstruct the ink discharge, deflect a discharge direction, or adversely affect image recording. To prevent this situation, a cleaning operation for removing foreign matters such as ink, water, and dust which have stuck to the discharge port surface is required.

As means for this purpose, wiping means for wiping the discharge port surface with a predetermined member is used. This wiping means generally brings an edge portion or the vicinity of an edge of a plate-like blade member into contact with the discharge port surface to move the member, and accordingly sweeps/takes/removes (wipes) the foreign matters such as ink which have stuck to the discharge port surface. It is to be noted that in the present application, an operation for removing and purifying the ink or the like which has stuck to the discharge port surface of the recording means by desired cleaning means is referred to as a wiping operation (cleaning operation).

Moreover, when clogging occurs in the discharge port by ink dried and thicken in the discharge port of a recording head, dirt or dust entering the discharge port, or bubbles generated in the ink in the discharge port, the discharging of the ink becomes defective or the discharge direction is deflected in the clogged discharge port, and a recorded image is sometimes deteriorated or disturbed. Therefore, as means for preventing this disadvantage, discharge recovery means is disposed for a purpose of forcibly discharging the ink from the discharge port to refresh the ink in the discharge port. As the discharge recovery means, a suction recovery operation for applying a negative pressure to the discharge port to suck/discharge the ink, a pressurizing recovery operation for pressurizing the ink in the recording head to discharge the ink from the discharge port, an empty discharge (or idle discharge) operation for driving discharge energy generation means to discharge the ink in the same manner as in a recording time and the like are used. Since the ink or the like sticks to the discharge port surface even by the ink discharge in the recovery operation, the operation for cleaning the discharge port surface is required even after the discharging of the ink in addition to after the recording.

However, since only the wiping operation has been usually performed in a conventional ink jet recording apparatus, the foreign matters such as the ink sticking to the discharge port surface cannot be necessarily quickly or securely removed, and it has been difficult to constantly keep the discharge port surface to be clean. Especially in a full-line type recording head using a large number of discharge ports, the number of discharge ports is remarkably large as compared with a serial type, and an area requiring the cleaning is also large. Therefore, it has become difficult to effectively clean the ink, water, dust or the like sticking to the discharge port surface in many cases. Especially there has been a disadvantage that during the cleaning of the foreign matters such as ink and water on the discharge port surface, the foreign matters such as ink and dust collected by the blade member and moved on the discharge port surface fall backwards or sideways from a cleaning direction, and cannot be completely cleaned.

SUMMARY OF THE INVENTION

An object of the present invention is to provide an ink jet recording apparatus capable of securely cleaning foreign matters such as ink attached to a discharge port surface of recording means and capable of preventing a discharge failure of the ink or deviation in a discharge direction to perform satisfactory recording.

Another object of the present invention is to provide an ink jet recording apparatus for discharging ink from a discharge port of recording means to a material to be recorded so as to perform recording, including: an ink absorbing member for wiping/removing foreign matters such as ink attached to a discharge port surface in which the discharge port is disposed; and a wiping member for sweeping/removing the foreign matters such as the ink which has stuck to the discharge port surface, wherein the ink absorbing member and the wiping member are moved along the discharge port surface and along an arrangement direction of the discharge ports.

DESCRIPTION OF THE PREFERRED EMBODIMENTS

Figure 1:
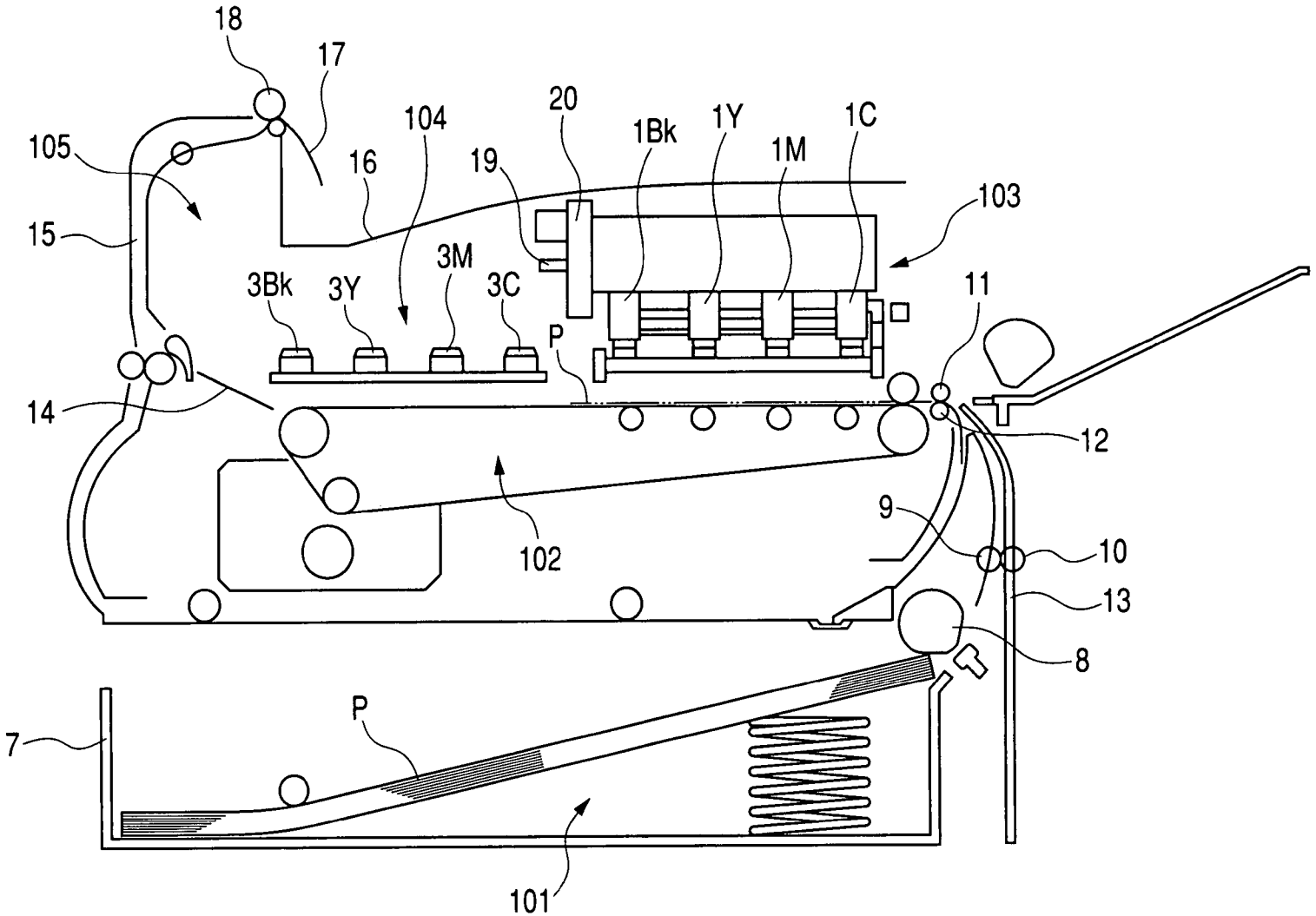
FIG. 1 is a schematic longitudinal sectional view showing a first embodiment of the present invention.

Embodiments of the present invention will be described hereinafter concretely with reference to the drawings. It is to be noted that through the drawings the same reference numeral shows the same or corresponding portion.

First Embodiment

FIG. 1 is a schematic longitudinal sectional view showing a first embodiment of an ink jet recording apparatus to which the present invention is preferably applied. In FIG. 1, reference numeral 1 denotes a recording head which is recording means, and 3 denotes a cap for covering a discharge port surface of the recording head 1. Reference numeral 7 denotes a recording sheet cassette in which recording sheets are stored as materials to be recorded, and 8 denotes a sheet supply roller for sending the recording sheets in the recording sheet cassette sheet by sheet. Reference numerals 9, 10 denote a conveying roller pair for conveying the sent recording sheet, 11, 12 denote a registration roller pair for positioning the recording sheet to be conveyed into a recording section, and 14, 15 denote guides for conveyance, for guiding the conveyed recording sheet. Reference numeral 16 denotes a sheet discharge tray for holding the discharged recording sheet, 17 denotes a sheet discharge flap, and 18 denotes a sheet discharge roller. Reference numeral 19 denotes a sensor for detecting a position of the recording head, and 20 denotes a rack gear for moving the recording head 1 in a vertical direction.

In FIG. 1, a recording sheet P stored in a sheet supply section 101 (the recording sheet cassette 7) is sent toward a belt conveying section 102 by the sheet supply roller 8. When the sent recording sheet passes through the belt conveying section 102, an image (including characters or symbols) is recorded on the recording sheet P by a recording head section 103. The recorded recording sheet P is discharged to the sheet discharge tray 16 via a sheet discharge section 105. Each recording head 1 constituting the recording head section 103 is constituted of recording means of a full-line type capable of substantially simultaneously forming an image in a width direction of the recording sheet P in the present embodiment.

Figure 2:
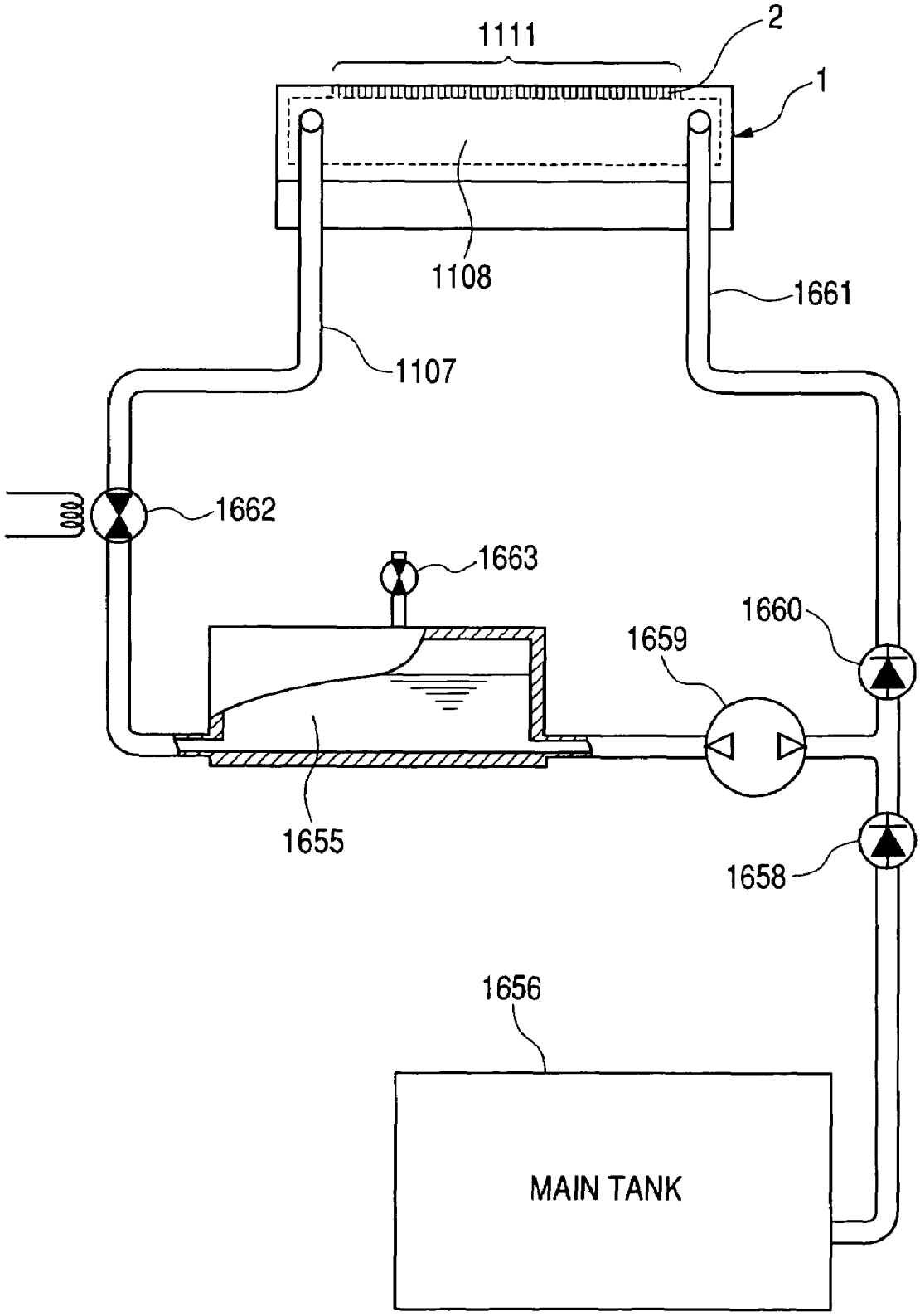
FIG. 2 is an explanatory view showing schematic constitutions of an ink supply system and a pressurizing circulation recovery system with respect to recording means of an ink jet recording apparatus to which the present invention is applied.

Reference numeral 104 denotes a cap section which abuts on a discharge port surface 2 (FIG. 3) of each recording head 1 of the recording head section 103 to cover discharge ports 1111 (FIG. 2). In a shown example, in the cap section 104, a plurality of (four) caps 3C, 3M, 3Y, 3BK are disposed for a plurality of (four) recording heads 1C, 1M, 1Y, 1BK using different types of ink.

It is to be noted that in the present application, the same type of plural members which are different from one another in a type of ink for use (ink color or the like) are displayed in numerals with added symbols like 1C, 1M, 1Y, 1BK as described above, but when denoting all or optional one of members of the same type, the symbols are omitted, and only the numerals are displayed simply.

The cap section 104 has a protective function of tightly closing the discharge ports 1111 with the caps 3 formed of rubber-like elastic materials to prevent the ink in the discharge ports from being evaporated (thickened) and maintaining the recording head 1 constantly in a recordable state. FIG. 1 shows a state at a recording operation time, and each cap 3 constituting a pat of a recovery device for maintaining/recovering an ink discharge performance of each recording head 1 is detached/retracted from each recording head 1.

The recording head 1 is ink jet recording means for discharging the ink using a heat energy, and includes, an electrothermal converting member for producing the heat energy. The recording head 1 discharges the ink from the discharge ports using a pressure change (state change) by the growth of bubbles by film boiling caused by the heat energy applied by the electrothermal converting member and the contraction of bubbles to perform the recording.

Figure 23:
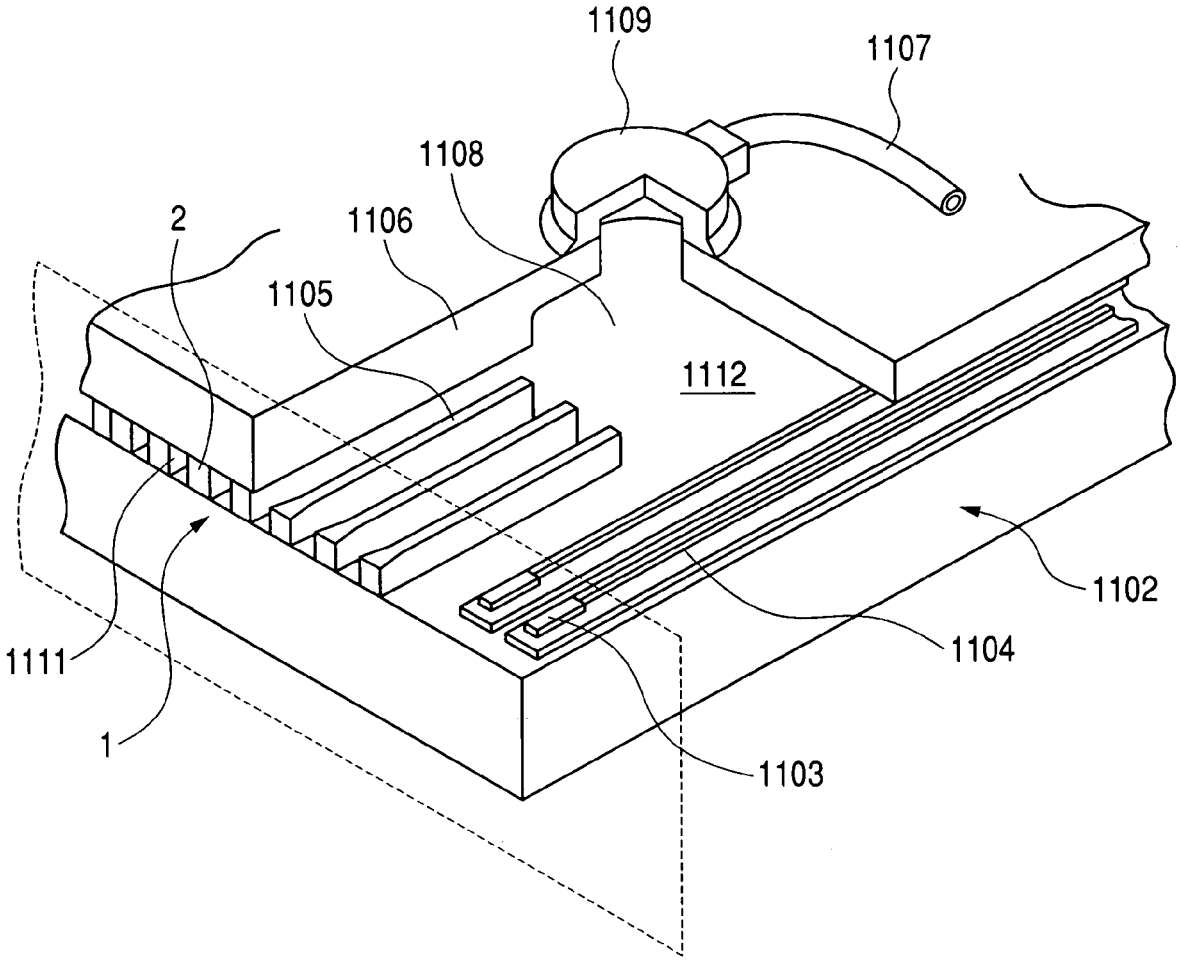
FIG. 23 is a partial perspective view showing a partly broken internal structure of the recording means of the ink jet recording apparatus to which the present invention is preferably applied.

FIG. 2 is an explanatory view showing schematic constitutions of an ink supply system and a pressurizing circulation recovery system an ink jet recording apparatus to which the present invention is applied. FIG. 23 is a partial perspective view showing a partly broken internal structure of the recording means of the ink jet recording apparatus to which the present invention is preferably applied. These constitutions relate to a recording head of a full-line type capable of substantially simultaneously forming an image in a width direction of the recording sheet. First, an ink supply operation and ink pressurizing operation (pressurizing circulation operation) with respect to the ink jet recording head 1 of a longitudinal full-line type will be described with reference to the drawings. In FIG. 2, reference numeral 1 denotes an ink jet recording head of the full-line type, 1111 denotes a plurality of discharge ports formed in a predetermined arrangement on the discharge port surface 2 of the recording head 1, and 1108 denotes a common liquid chamber formed in the recording head and connected to the respective discharge ports 1111. In the discharge port surface 2, a discharge port row is formed of a large number of discharge ports 1111 arranged over a range corresponding to a recordable width of the recording sheet which is an object. According to the recording means of the line type, an electrothermal converting member 1103 (FIG. 23) disposed in a liquid path 1110 connected to the individual discharge ports 1111 is selectively driven based on image information to discharge ink, and the recording can be performed without main scanning by the recording head.

In FIG. 2, reference numeral 1655 denotes a sub-tank (ink supply tank) for supplying the ink to the recording head 1, and 1656 denotes a main tank for replenishing the ink to the sub-tank 1655. Reference numeral 1107 denotes an ink supply tube for supplying the ink to the common liquid chamber 1108 of the recording head 1 from the sub-tank 1655, and 1662 denotes an electromagnetic valve disposed in the ink supply tube 1107. To replenish the ink into the sub-tank 1655, when a recovery pump 1659 is driven, the ink can be fed into the sub-tank 1655 from the main tank 1656 through a rectifier valve for replenishment 1658 which is a one-way passage. An air vent valve 1663 is disposed in the sub-tank 1655.

In FIG. 2, reference numeral 1660 denotes a rectifier valve for recovery of one-way passage for use at the time of the ink pressurizing operation for recovering the recording head 1, and 1661 denotes a tube for circulation leading to the common liquid chamber 1108 of the recording head 1 from the sub-tank 1655. The rectifier valve for recovery 1660 is disposed between the recovery pump 1659 of the tube for circulation 1661 and the recording head 1. In the ink supply system and the discharge recovery system constituted in this manner, the ink in the sub-tank 1655 is supplied to the common liquid chamber 1108 of the recording head 1 by a water head difference, and the ink in the common liquid chamber 1108 is guided to each discharge ports 1111 through the liquid path 1110 (FIG. 23) in an open state of the electromagnetic valve 1662 at a recording operation time.

Moreover, when the recovery pump 1659 is driven in the open states of the rectifier valve for recovery 1660 and the electromagnetic valve 1662 at the time of the ink pressurizing operation performed for purposes of cooling the recording head 1 and removing bubbles remaining in the ink supply system, the ink in the sub-tank 1655 is fed into the common liquid chamber 1108 through the circulation tube 1661, and further the ink in the common liquid chamber 1108 is circulated into the sub-tank 1655 through the ink supply tube 1107. A predetermined amount of ink is discharged from all the discharge ports 1111 of the recording head 1 at an ink pressurizing operation time. Moreover, when the recovery pump 1659 is driven in a closed state of the electromagnetic valve 1662 at the time of initial filling of each liquid path 1110 of the recording head 1 with the ink, the ink in the sub-tank 1655 is fed with pressure into the common liquid chamber 1108 through the circulation tube 1661, and bubbles in the liquid path 1110 is discharged from the discharge ports 1111 together with the ink while charging the ink into the liquid path 1110.

In the ink jet recording head 1, in a usual case, the ink is left stand in the recording head 1 (in the liquid path 1110 and the like) at a non-recording time. Then, the cap section 104 is disposed including the caps 3 (FIG. 4) of rubber-like elastic materials which abut on the discharge port surface 2 of each recording head 1 to tightly close the discharge ports 1111. At the non-recording time, the caps 3 are brought into close contact with the discharge port surface 2 to tightly close the discharge ports 1111. Moreover, spaces in the caps are filled with ink steam to set a saturated steam pressure, and accordingly the ink in the discharge ports 1111 is prevented from being evaporated or thickened in the constitution.

However, under a low-temperature environment or in a recording stop for a long period, even when the capping is performed as described above, ink viscosity sometimes increases, and discharge defect or unstable discharge of the ink is sometimes caused during the recording after the recording stop period. In the present application, a problem as to whether or not the ink is normally discharged first after the recording stop is referred to as "first jet problem." To solve the first jet problem, as described above, the ink-pressurizing operation is sometimes performed so that the recovery pump 1659 is driven to pressurize/circulate the ink, and accordingly the ink is discharged from all the discharge ports. Alternatively, when the state of the discharge defect is comparatively minor, an "empty (or idle) discharge operation" is sometimes performed such that discharge energy generation means of the recording head is driven to discharge the ink from all the discharge ports in the same manner as in the recording time. This empty discharge operation is also a recovery operation.

Figure 3A:
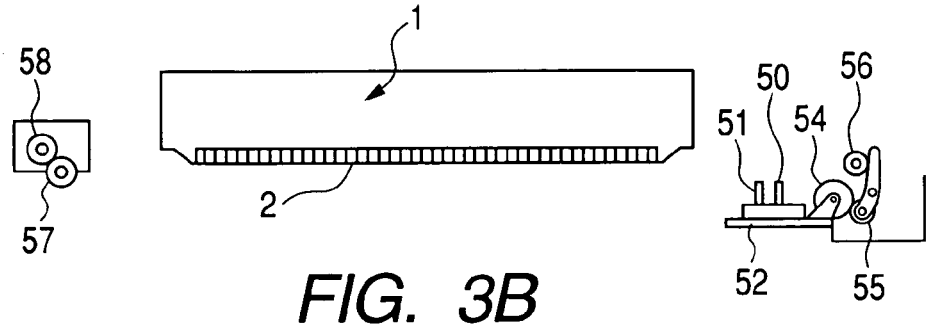
FIGS. 3A, 3B, 3C, 3D, 3E, and 3F are explanatory views showing a series of discharge port surface cleaning operation in the first embodiment of the present invention.
Figure 3B:
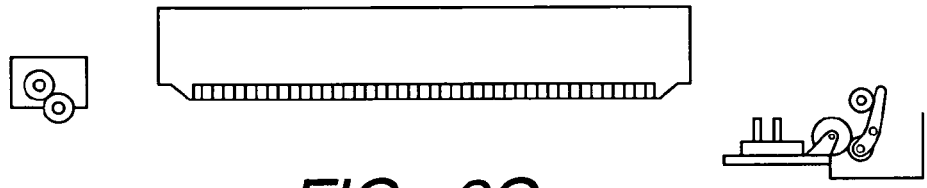
Figure 3C:
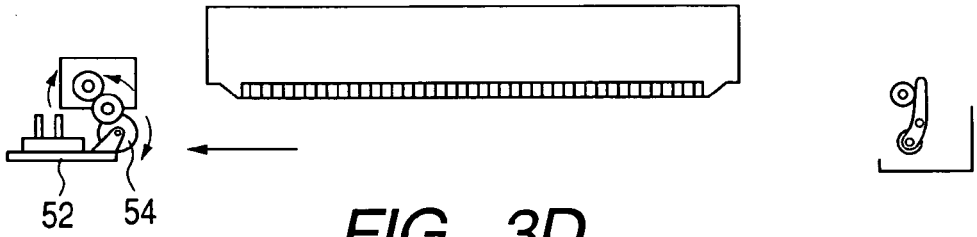
Figure 3D:
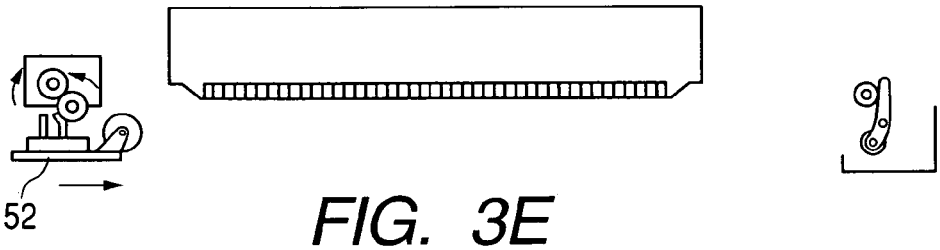
Figure 3E:
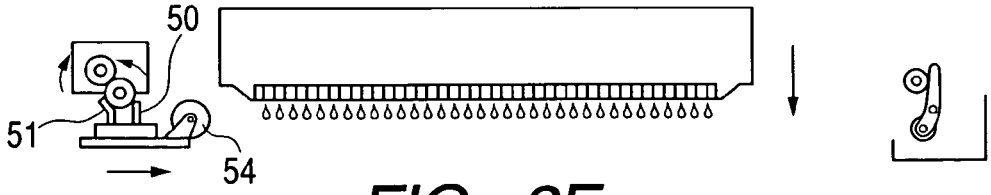
Figure 3F:
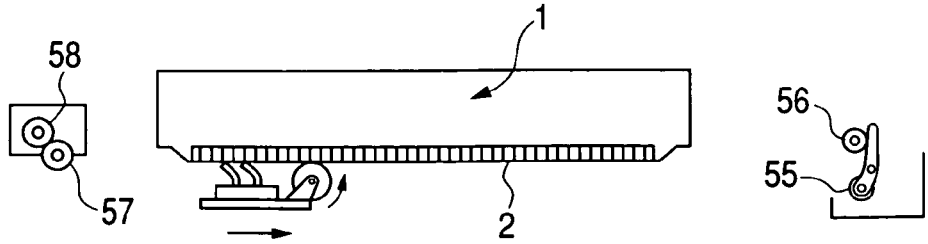
Figure 4:
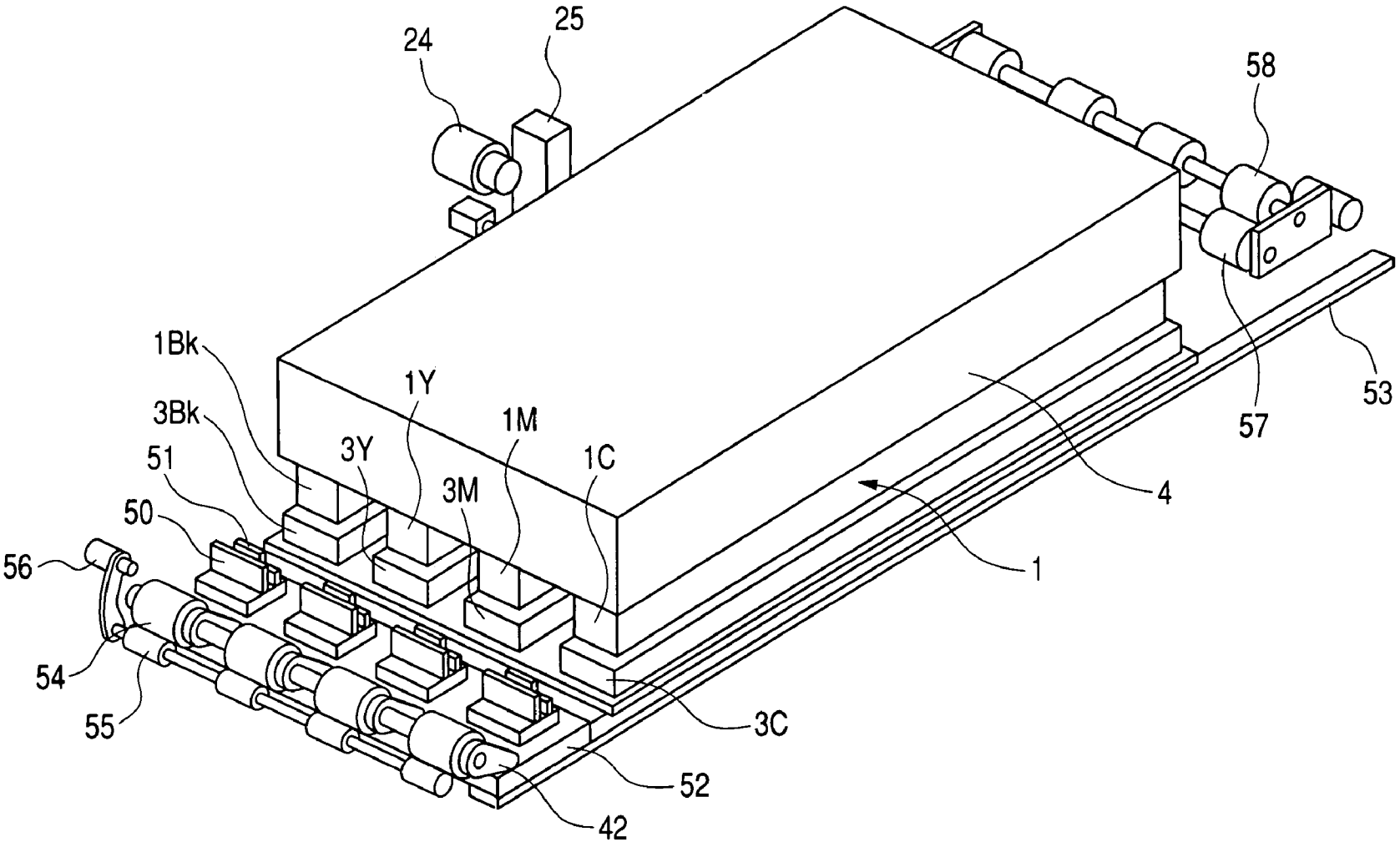
FIG. 4 is a schematic perspective view showing a capping state of the recording means and a discharge port surface cleaning device in the first embodiment of the present invention.
Figure 5:
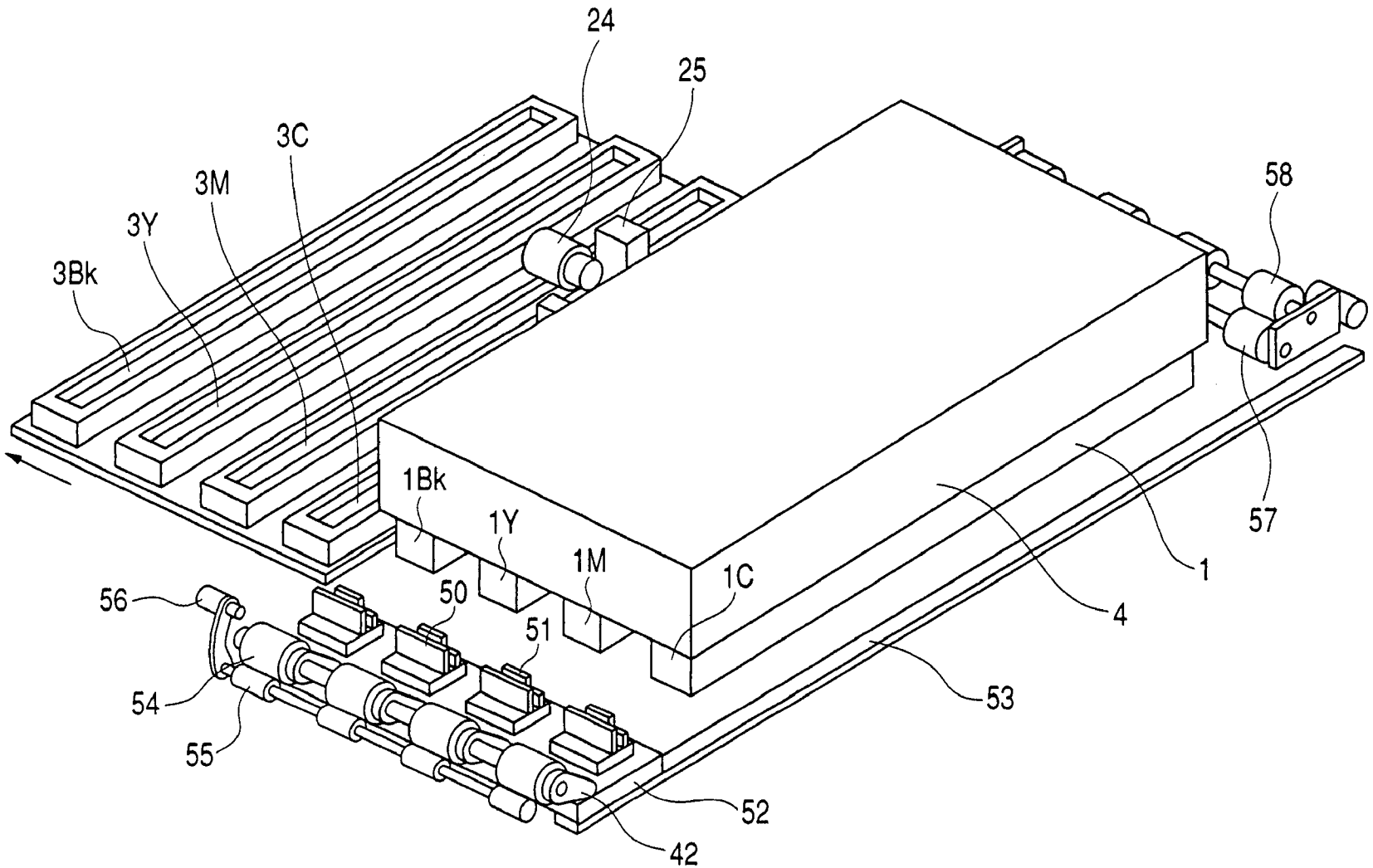
FIG. 5 is a schematic perspective view showing a state in which a cap is detached (or set apart)/retracted from the recording means in the recording means and the discharge port surface cleaning device of FIG. 4.
Figure 6:
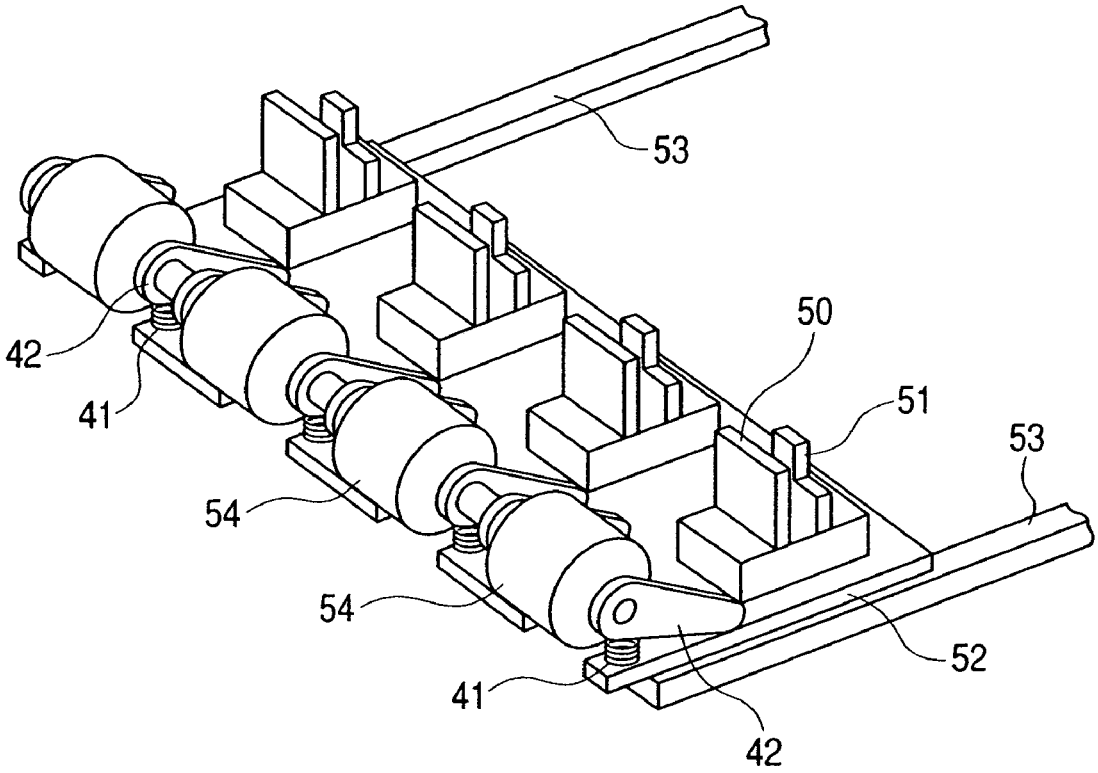
FIG. 6 is a schematic perspective view showing the discharge port surface cleaning device in FIG. 4.
Figure 7:
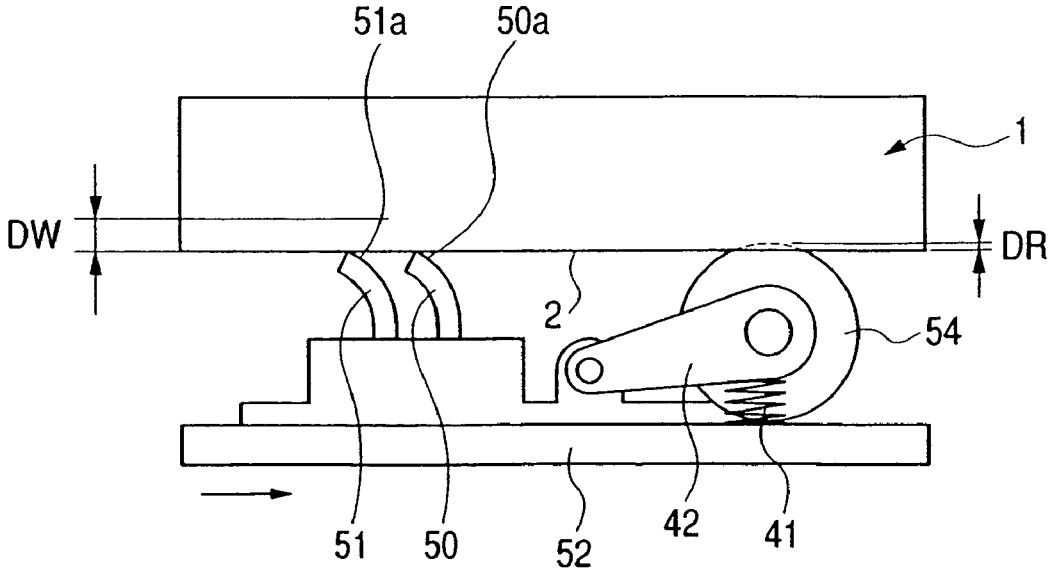
FIG. 7 is a schematic side view showing a state in which the discharge port surface of the recording means is wiped by the discharge port surface cleaning device of FIG. 6.

FIGS. 3A to 3F are explanatory views showing a series of discharge port surface cleaning operation in the first embodiment of the present invention, FIG. 4 is a schematic perspective view showing a capping state of the recording means and a discharge port surface cleaning device in the first embodiment of the present invention, and FIG. 5 is a schematic perspective view showing a state in which the caps are detached (or set apart)/retracted from the recording means and the discharge port surface cleaning device of FIG. 4. FIG. 6 is a schematic perspective view showing the discharge port surface cleaning device in FIG. 4, and FIG. 7 is a schematic side-view showing a state at a time when the discharge port surface of the recording means is wiped by the discharge port surface cleaning device of FIG. 6. Next, a constitution and operation of the discharge port surface cleaning device in the first embodiment of the present invention will be described with reference to FIGS. 3A to 3F through 7.

In FIG. 4, a plurality of recording heads 1C, 1M, 1Y, 1BK using ink of different inks are used in the ink jet recording apparatus according to the present embodiment. In these recording heads, inks of cyan, magenta, yellow and black are used. These recording heads are positioned/fixed with respect to a head holder 4 with good precision, and parallelism, inter-head distance and the like of the respective recording heads are ensured in a desired precision.

When an instruction signal for the discharge port surface cleaning operation is sent from a controller of the recording apparatus after the recording onto the recording sheet P, or after the ink pressurizing operation or the empty discharge operation for forcibly discharging the ink from the discharge ports 1111 to solve the clogging of the recording head, a capping state shown in FIG. 4 is shifted to a cap detached (or set apart)/retracted state shown in FIG. 5. The shifting to the cap detached/retracted state is performed by driving a motor 24 to move the head holder 4 in an upward direction along a vertical guide 25 and thus move the recording head 1 upward, and subsequently moving the caps 3 in a horizontal direction by a predetermined distance. Moreover, when the discharge port surface cleaning device is operated in the cap detached/retracted state of FIG. 5, a series of discharge port surface cleaning operation is performed.

In FIGS. 5 and 6, reference numeral 54 denotes an ink absorbing member (absorbing roller) for wiping/absorbing foreign matters such as ink attached to the discharge port surface 2, and is formed of a rotatable roller-shaped porous absorbing material in the present embodiment. Examples of the material of the absorbing roller 54 preferably include materials superior in water absorptivity, such as a hydrophilic porous polyurethane resin and a hydrophilic porous polyethylene resin.

Reference numerals 50, 51 denote wiping members (wipers) for wiping/removing the foreign matters such as ink and dust attached to the discharge port surface 2, and each of the members is constituted of a plate-shaped rubber-like elastic material. The examples of the material of the wiping member preferably include elastic materials (rubber-like elastic materials) such as a urethane resin. The present embodiment uses a constitution in which two wipers 50, 51 are used for each recording head 1. Especially in a longitudinal head such as the recording head 1 of the full-line type, to enhance a wiping effect, the ink is wiped off the whole discharge port surface by the preceding wiper 50, and the portion of the discharge port (discharge port row) is preferably wiped by the following wiper 51.

In FIGS. 5 and 6, reference numeral 52 denotes a wiper holder to which the absorbing roller 54 and wipers 50, 51 are attached. The wiper holder 52 is constituted to be movable on a rail 53 along a discharge port arrangement direction of the discharge port surface 2 by a driving source (not shown). When the wiper holder 52 moves in a position facing the discharge port surface 2 on the rail 53, the absorbing roller 54 and wipers 50, 51 move with a certain invasion amount (overlap amount) and abutment pressure with respect to the discharge port surface 2. That is, when the absorbing roller 54 and wipers 50, 51 are moved in a contact state in the arrangement direction of the discharge ports along the discharge port surface 2, the foreign matters such as ink attached to the discharge port surface 2 are removed. In this case, the absorbing roller 54 is disposed so as to move ahead of the wipers 50, 51 in a moving direction. In the present embodiment, as shown in FIGS. 6 and 7, the absorbing rollers 54 attached via rocking arms 42 are disposed in such a manner that the rollers can be pressed/moved downwards via elastic members (compression springs) 41 disposed between the absorbing rollers and the wiper holder 52, an abutment force with respect to the discharge port surface 2 is obtained by an elastic force of the spring.

A positional relation of the absorbing roller 54 and wipers 50, 51 with respect to the discharge port surface 2 at a time when the discharge port surface 2 is wiped is shown in FIG. 7. In FIG. 7, in the cleaning device for wiping the discharge port surface 2, the absorbing roller 54 is disposed on a preceding side with respect to the moving direction of the wiper holder 52, and the wipers 50, 51 are disposed in a following side. The wipers 50, 51 contact the discharge port surface with a certain invasion amount (overlap amount) DW, and a tip edge portion or a surface in the vicinity of an edge of each wiper bends, so that wiper edge portions 50*a*, 51*a* are disposed in positions capable of correctly contacting/moving with respect to the discharge port surface 2.

Moreover, the surface of the absorbing roller 54 contacts the discharge port surface 2 with a certain invasion amount DR, and the absorbing roller is disposed in a position where correct contact movement is possible in a state in which a contact surface (nip portion) is formed between the surface of the absorbing roller 54 and the discharge port surface 2. In the present embodiment, the absorbing roller 54 does not include any driving means with respect to a rotation direction, and is constituted to be freely rotatable. That is, when the absorbing roller 54 moves in contact with the discharge port surface 2, the absorbing roller rotates following the discharge port surface 2 by its moving force. Accordingly, the ink or the like on the discharge port surface can be wiped and absorbed without rubbing the discharge port surface 2.

According to the constitution, when the wiper holder 52 contact-moves to the other end from one end of the discharge port arrangement direction along the discharge port surface 2, the discharge port surface is wiped by the absorbing roller 54 and wipers 50, 51 mounted on the wiper holder to remove the foreign matters such as ink droplets, water droplets, and dust on the discharge port surface.

Next, a series of discharge port surface cleaning operation in the first embodiment of the present invention will be described with reference to FIGS. 3A to 3F.

FIG. 3A shows a head cleaning standby state, and the cap 3 is detached from the recording head 1 in this state. That is, when the head holder 4 is moved in an upward direction along the vertical guide 25 by driving the motor 24 from the capping state, the recording head 1 is moved upwards. Next, the cap 3 is moved in a horizontal direction by a predetermined distance, and is accordingly brought into a detached state from the recording head 1.

FIG. 3B shows a state of an ink discharge operation (ink squeezing operation) for squeezing and discharging the ink absorbed by the absorbing roller 54. Ink discharge means for discharging the ink from the absorbing roller 54 is disposed in a position on the right side of the drawing, which is a home position of the wiper holder 52. The means is constituted to squeeze the ink absorbed by the absorbing roller 54, when absorbing roller 54 is pressed/deformed by a squeezing roller 55 for each recording head in the ink discharge position, and the squeezed ink is allowed to drop.

In the ink discharge means of FIG. 3B, when the squeezing roller 55 is rotated in an arrow direction in a pressed state onto the absorbing roller 54 by a squeezing cam 56 driven by the driving means (not shown), the ink absorbed by the absorbing roller 54 is mechanical squeezed, and the squeezed ink is allowed to drop and is recovered. FIG. 3B shows a state at a time when the absorbing roller 54 is squeezed by the squeezing roller 55. This ink discharge operation is performed subsequently to the standby state of FIG. 3A.

The driving of the squeezing roller 55 in FIG. 3B ends, when the squeezing cam 56 is rotated after elapse of a predetermined certain time to release the pressed state, and accordingly the rotation of the squeezing roller 55 is stopped. In this case, a driving time of the ink squeezing operation is determined by a use state of the recording apparatus, an amount of ink, and a time interval of the discharge port surface cleaning operation and the like.

It is to be noted that in the present embodiment, the squeezing rollers 55 for the respective colors (55C, 55M, 55Y, 55BK) are driven simultaneously for all the colors by driving the common squeezing cam 56, and the ink squeezing operation is performed, but the ink squeezing operation may also be individually performed for each color. In this case, for example, driving means are disposed for the respective colors, and may be individually or selectively driven.

FIG. 3C shows a purifying operation for purifying a wiping member cleaning means (first cleaning roller) 57 for wiping the foreign matters such as the ink attached to the wipers 50, 51. In the present embodiment, the first cleaning roller 57 is purified using the absorbing roller 54. That is, when the wipers 50, 51 are cleaned, the foreign matters such as the ink transferred to the first cleaning roller 57 are wiped/removed (purified) using the absorbing roller 54. In the present embodiment, cleaning rollers 57, 58 are positioned on the left side of the drawings. Therefore, the purifying operation of FIG. 3C is performed in the position on the left side of the drawing after completing the ink discharge operation of FIG. 3B and moving the wiper holder 52 in a left direction.

The cleaning rollers 57, 58 are formed by materials superior in water absorptivity, such as a hydrophilic porous polyurethane resin or a hydrophilic porous polyethylene resin in the same manner as in the absorbing roller 54. Moreover, in the purifying operation in FIG. 3C, the absorbing roller 54 is brought into contact with the first cleaning roller 57 so that the rollers face each other, and the first cleaning roller 57 is rotated/driven in a shown arrow direction to press/deform both the rollers. Accordingly, the ink or the like absorbed in the first cleaning roller 57 is absorbed on the side of the absorbing roller 54, and dust, nap, paper powder and the like deposited on the first cleaning roller 57 are transferred on the side of the absorbing roller 54.

The second cleaning roller 58 is brought into contact with the first cleaning roller 57 with a predetermined abutment pressure so that the second cleaning roller can be driven/rotated. Moreover, when the first cleaning roller 57 is rotated/driven in an arrow direction in this state, the purifying operation of the first cleaning roller 57 is performed, and the rotating/driving of the first cleaning roller 57 is stopped after elapse of a predetermined certain time to end the purifying operation. A time of the purifying operation is also determined by specifications of the recording apparatus, the amount of ink, the time interval of the discharge port surface cleaning operation and the like.

Furthermore, the foreign matters such as the ink transferred to the absorbing roller 54 from the first cleaning roller 57 by the purifying operation of FIG. 3C are mechanical squeezed at the time of the ink discharge operation of FIG. 3B, allowed to drop, discharged, and recovered. It is to be noted that the present embodiment is constituted such that all the first cleaning rollers 57 for the respective colors (57C, 57M, 57Y, 57BK) are simultaneously driven to perform the purifying operation by the ink transfer or the like, but the purifying operation may also be individually performed for each color. In this case, for example, the driving means are disposed for the respective colors, and may be constituted to individually or selectively drive the roller.

FIGS. 3D to 3F are diagrams showing the cleaning operation of the wipers 50, 51 performed before the discharge port surface wiping operation (operation for removing the foreign matters such as the ink attached to the discharge port surface 2) of FIG. 3F. The cleaning operation is performed to wipe the foreign matters such as the ink attached to the wipers 50, 51 by the first cleaning roller 57. In the present embodiment, the wiping member cleaning operation is performed subsequently to the purifying operation of the first cleaning roller 57 of FIG. 3C.

The cleaning operation of the wiping member in FIGS. 3D, 3E is performed, when the portions of the wipers 50, 51 in the vicinity of the edge portions are disposed facing and brought into contact with the first cleaning roller 57 by a certain pressure or invasion amount and further the first cleaning roller 57 is rotated/driven. This cleaning operation is performed by an operation for transferring/absorbing the foreign matters such as the ink, dust, nap, and paper powder left or deposited in the vicinity of the edge portion of the wiper (foreign matters transferred by the wiping operation) onto the side of the cleaning roller 57.

When the purifying operation of the cleaning roller 57 of FIG. 3C ends, the wiper holder 52 moves slightly in a shown right direction along the rail 53, and is stopped in a position of FIG. 3D. This position is referred to as a first cleaning position. In the first cleaning position, the vicinity of the edge portion of the wiper 50 contacts the cleaning roller 57 with the certain invasion amount and contact pressure. When the cleaning roller 57 is rotated/driven in a shown arrow direction in this position, the foreign matters such as the ink, dust, nap, and paper powder deposited in the vicinity of the edge portion of the wiper 50 are absorbed, transferred, and scratched by the cleaning roller 57. The foreign matters such as the ink transferred to the cleaning roller 57 from the wiper 50 are transferred to the absorbing roller 54 at the time of the purifying operation of FIG. 3C, and mechanically squeezed, dropped, and discharged from the absorbing roller 54 at the time of the ink discharge operation of FIG. 3B.

When the cleaning operation of the wiper 50 ends after the elapse of a certain time, the wiper holder 52 is moved in a shown right direction and stopped in a position of FIG. 3E. The position of FIG. 3E is referred to as a second cleaning position. In the second cleaning position, the vicinity of the edge portion of the other wiper 51 contacts the cleaning roller 57 with the certain invasion amount and contact pressure. When the cleaning roller 57 is rotated/driven in the shown arrow direction, the foreign matters such as the ink, dust, nap, and paper powder deposited in the vicinity of the edge portion of the wiper 51 are absorbed, transferred, and scratched by the cleaning roller 57. The foreign matters such as the ink transferred to the cleaning roller 57 from the wiper 51 are transferred to the absorbing roller 54 at the time of the purifying operation of FIG. 3C, and are mechanically squeezed, dropped, and discharged from the absorbing roller 54 at the time of the ink discharge operation of FIG. 3B. Each of the cleaning operations of the wipers 50, 51 in FIGS. 3D, 3E ends, when the rotating/driving of the first cleaning roller 57 is stopped after the elapse of a predetermined certain time. The set driving time of the cleaning operation is also determined by the specifications of the recording apparatus, the amount of ink, the time interval of the discharge port surface cleaning operation and the like.

It is to be noted that in the present embodiment, one cleaning roller 57 directly contacts the wipers 50, 51, and the other cleaning roller 58 is disposed to be rotated/driven in a contact state with respect to the cleaning roller 57. The second cleaning roller 58 is also formed of a material similar to that of the first cleaning roller 57. The wiping member cleaning means is constituted of two cleaning rollers 57, 58 in order to enhance an ink absorbing capability of the cleaning roller. It is to be noted that one cleaning roller constitution may also be adopted in a case where it provides a sufficient ink absorbing capability. To further enhance the ink absorbing capability, wiping member cleaning means constituted of three or more cleaning rollers may also be disposed for each recording head.

Moreover, the present embodiment is constituted to clean the edge portions of the wipers 50, 51, when the wiper holder 52 is stopped in each position of FIGS. 3D, 3E, but the wiping edge portion may also be cleaned by rubbing the cleaning roller against the wiper without stopping the wiper depending on conditions such as a wiping speed by the wiper, an outer diameter of the wiping member cleaning roller, and an outer shape (size) of the wiper.

It is to be noted that in the present embodiment, the rotating/driving of the cleaning roller 57 is stopped, while the wiper holder 52 moves to the position of the cleaning operation of the second wiper in FIG. 3E from the position of the purifying operation in FIG. 3C. However, the wiper holder 52 may also be moved without stopping the rotating/driving of the cleaning roller 57, even while the holder moves between these positions.

Moreover, a rotation direction or speed of the first cleaning roller 57 has to be set uniquely to the recording apparatus, and the wiper may also be cleaned in a stopped state without rotating/driving the wiper. In this constitution, the wiper is rubbed against the cleaning roller surface, and a broad range in the vicinity of the edge portion of the wiper can be cleaned. One or both of the cleaning rollers 57, 58 may also be integrated/structure in common to a plurality of recording heads.

FIG. 3F is a diagram showing a wiping operation for wiping (cleaning) the foreign matters such as the ink on the discharge port surface 2 of the recording head 1. The wiping operation is performed subsequently to the cleaning operation of the wiper in FIGS. 3D, 3E. In the present embodiment, the wiping operation for cleaning the discharge port surface 2 is performed by the absorbing roller 54 and wipers 50, 51 attached to the wiper holder, when the wiper holder 52 is moved to the right from the left along the discharge port surface as shown. In the present embodiment, as shown in FIGS. 6 and 7, the absorbing roller 54 attached via the rocking arm 42 is attached such that the roller can be pressed/moved downwards via the compression spring 41 disposed between the roller and the wiper holder 52, and the abutment force of the absorbing roller 54 onto the discharge port surface 2 is regulated by the elastic force of the compression spring 41. The wiping operation of the discharge port surface of 3F is performed after the ink pressurizing operation or the empty discharge operation in which the ink is discharged from the discharge ports of the recording head.

That is, when the cleaning operation of the wiper of FIGS. 3D, 3E ends, first in the constitution shown in FIGS. 2 and 23, the recovery pump 1659 is driven to pressurize/circulate the ink through the common liquid chamber 1108 of the recording head 1, and accordingly the ink is discharged from all the discharge ports 1111 of the recording head. The ink pressurizing operation is executed in this manner. Alternatively, when the state of discharge failure of the recording head is minor, that is, when the dirt on the discharge port surface or the state of the thickened ink is minor, instead of the ink pressurizing operation, the empty (or idle) discharge operation is executed. In the operation, energy generation means constituted of the electrothermal converting member 1103 of the recording head is driven to discharge the ink from all the discharge ports in the same manner as in the recording time. After the ink discharge from the discharge ports is executed, the ink and the like stick to the discharge port surface 2 by ink mist and the like. It is to be noted that the ink pressurizing operation is performed using a time (or state) of the cleaning operation of the wiper 51 in FIG. 3E.

To execute the wiping operation (cleaning operation) of the discharge port surface in FIG. 3F, the foreign matters such as the ink on the discharge port surface 2 are wiped/removed (wiped/absorbed) by the preceding absorbing roller 54, and the foreign matters such as the ink remaining on the discharge port surface 2 are wiped/removed by the following wipers 50, 51. Further in the present embodiment, the absorbing roller 54 does not include any driving means for the rotating/driving, and is constituted to be freely rotatable. Therefore, when the absorbing roller 54 contacts the discharge port surface 2 and moves in the discharge port surface wiping operation of FIG. 3F, the roller is driven/rotated with respect to the discharge port surface by its moving force, and the roller moves while wiping/absorbing the ink and the like without rubbing the discharge port surface.

On the other hand, the following wipers 50, 51 are brought into contact with the discharge port surface 2 subsequently to the absorbing roller 54, and move while wiping/removing the foreign matters such as the attached ink remaining on the discharge port surface wiped by the absorbing roller 54 by the edge portions or the surfaces in the vicinity of the edge portions of the rollers. Therefore, the foreign matters such as the ink attached to the discharge port surface 2 by the recording operation with respect to the recording sheet P, the pressurizing circulation recovery operation, or the empty discharge operation are effectively removed by the wiping operation in which the wiping operation by the absorbing roller 54 is combined with the sweeping operations by the wipers 50, 51. That is, when both functions of absorbing and wiping the ink are combined, even a long and broad discharge port surface as in the recording head of the longitudinal full-line type can be cleaned (wiped) with good efficiency.

When the wiper holder 52 moves to the vicinity of the shown right end portion via the shown position in FIG. 3F, this is detected by a sensor (not shown), and the wiper holder 52 is stopped. Accordingly, by the contact movement of the recording head in the arrangement direction of discharge ports along the discharge port surface, the wiping operation (cleaning operation) for wiping the foreign matters such as the ink ends. When the discharge port surface cleaning operation of FIG. 3F ends, next the motor 24 (FIG. 5) is driven to move the head holder 4 (FIG. 5) in the upward direction along the vertical guide 25 (FIG. 5), and accordingly the recording head 1 moves upwards to return to the head cleaning standby state of FIG. 3A.

Thereafter, the cap 3 is moved to a position facing the discharge port surface of the recording head, next the motor 24 is driven to move the head holder 4 in a downward direction along the vertical guide 25, the recording head 1 is moved downwards, and the discharge port surface 2 of each recording head is brought into close contact with each cap 3 and brought into the capping state. The capping state in such a state as shown in FIG. 4, in which the discharge port surface of the recording head is protected. When the state is returned to the capping state, a series of discharge port surface cleaning operation is completed. The capping state may also be shifted to the head cleaning standby state for preparing for the next series of discharge port surface cleaning operation. In the present embodiment, the absorbing roller 54 and the wipers 50, 51 are mounted on the wiper holder 52, the wiper holder 52 is moved, and the discharge port surface is wiped/cleaned by the preceding wiping/absorbing operation and the following sweeping operation.

It is to be noted that the absorbing roller 54, wipers 50, 51, and wiper holder 52 are individually for each of the plurality of recording heads 1 in a divided structure as in the present embodiment. Additionally, they can be integrated/structured in common to the plurality of recording heads as the case may be. In any case, two wipers are constituted as in the present embodiment (two-wiper constitution), one wiper may also be constituted, or three or more wipers may also be constituted. The absorbing roller and the wipers are mounted on the same wiper holder 52 in the present embodiment, but may also be mounted on separate holders.

Moreover, in the present embodiment, when the respective operations of FIGS. 3A to 3F are performed in order, the series of discharge port surface cleaning operation is performed. However, the order of the operations can be appropriately determined by a situation of the recording apparatus, cooperation with a recording operation, use situation of the recording apparatus and the like, and is not limited to the order of the operations as in the embodiment of the present invention. For example, the purifying operation for purifying the cleaning roller 57 of FIG. 3C, or the cleaning operation of the wipers of FIGS. 3D, 3E may also be executed in a mode to be operated alone in accordance with a recording situation of the recording apparatus. Moreover, when the discharge port surface is requested to be cleaned in a short time, for example, before the recording operation, only the wiping operation of the discharge port surface in FIG. 3F is preferentially executed, and the other operations may also be performed after the recording operation if necessary.

In the discharge port surface cleaning device of the ink jet recording apparatus according to the present embodiment, as apparent from an operation sequence of FIGS. 3A to 3F, (1) the standby, (2) the ink discharge operation from the absorbing roller, (3) the purifying operation of the cleaning roller, (4) the cleaning operation of the wipers, (5) the wiping/absorbing operation of the discharge port surface by the absorbing roller, and (6) the sweeping (wiping) operation of the discharge port surface by the wipers are combined to effectively clean the discharge port surface of the recording head. The series of operations and constitutions for the head cleaning are not limited to the contents described in the present embodiment, and the operations including the contents of the respective embodiments may also be appropriately combined and effectively performed if necessary.

Second Embodiment

FIGS. 8A to 8H are explanatory views showing a series of discharge port surface cleaning operation in a second embodiment of the present invention. Next, the discharge port surface cleaning operation in the second embodiment will be described in accordance with the constitution with reference to FIGS. 8A to 8H. It is to be noted that in the present embodiment, mainly a different respect from the first embodiment will be described, and parts that are not especially described are substantially the same as those of the first embodiment.

Figure 8A:
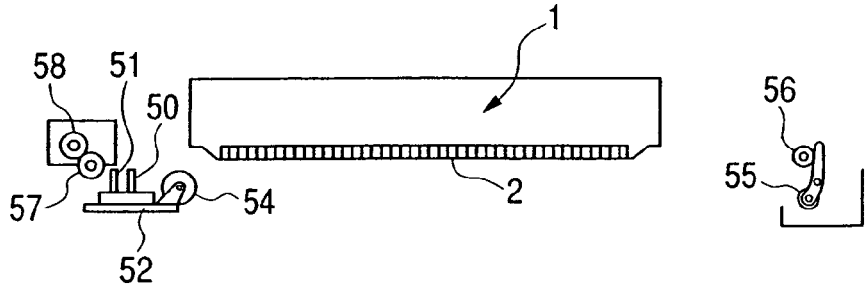
FIGS. 8A, 8B, 8C, 8D, 8E, 8F, 8G, and 8H are explanatory views showing a series of discharge port surface cleaning operation in a second embodiment of the present invention.
Figure 8B:
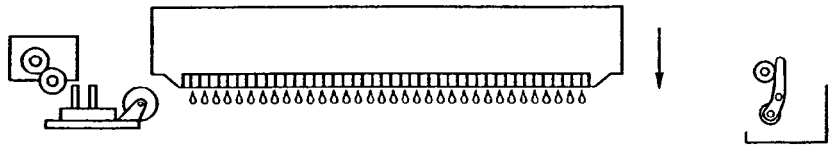

FIG. 8A shows a head cleaning standby state, and the cap 3 is detached from the recording head 1 as shown in FIG. 5. In the present embodiment, an ink pressurizing operation of the recording head in FIG. 8B is performed from the standby state.

Figure 8C:
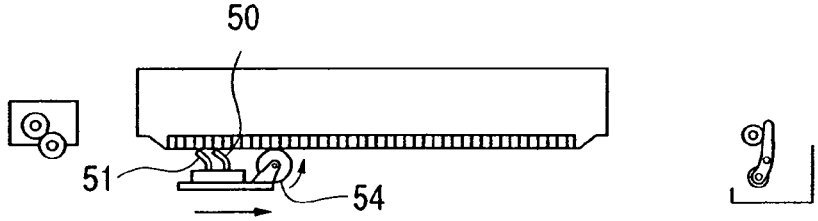

Next, when the motor 24 (FIG. 5) is driven to move downwards the head holder 4, the discharge port surface 2 of the recording head 1 is set to a position where the surface can be wiped by the absorbing roller 54 and the wipers 50, 51. Moreover, as shown in FIG. 8C, while the wiper holder 52 is moved along the rail 53 in a right direction in FIG. 8, the process enters the cleaning operation for wiping the discharge port surface 2 by the absorbing roller 54 and the wipers 50, 51. The wiping operation of the discharge port surface in FIG. 8C is substantially the same as that of FIG. 3F. That is, even in the present embodiment, after the ink pressurizing operation or the empty discharge operation, the wiper holder 52 is moved along the rail 53 to perform the wiping operation of the discharge port surface 2.

Figure 8D:
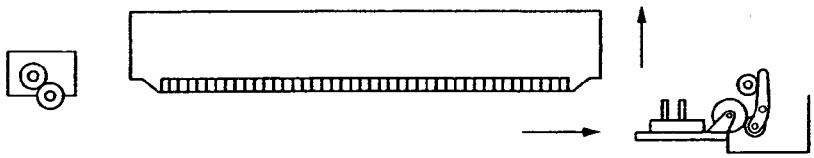
Figure 8E:
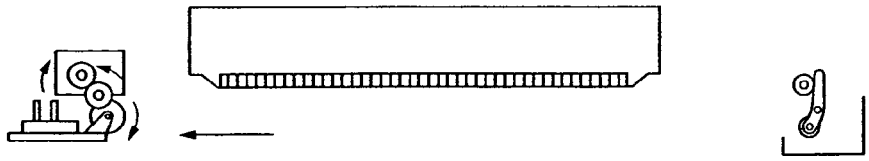

In FIG. 8, when the wiper holder 52 moves to the vicinity of a shown right end portion in FIG. 8D via a position shown in FIG. 8C, this is detected by a sensor (not shown), and the wiper holder 52 is stopped. Moreover, the motor 24 is driven to move the head holder 4 in the upward direction as shown by an arrow in FIG. 8D, and the recording head 1 is moved upwards to a height at the head cleaning standby time of FIG. 8A. FIG. 8E shows the purifying operation for cleaning the first cleaning roller 57. That is, after the operation of FIG. 8D, the wiper holder 52 is moved again in a shown left direction along the rail 53, and stopped in a position in the vicinity of a left end shown in FIG. 8E to enter the purifying operation of the cleaning roller 57 using the absorbing roller 54. The purifying operation in FIG. 8E is substantially the same as that of FIG. 3C.

Figure 8F:
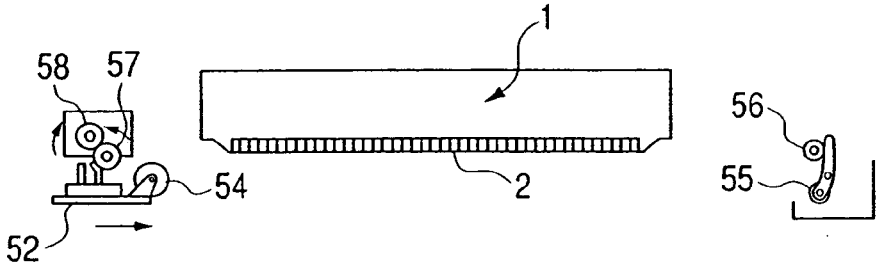
Figure 8G:
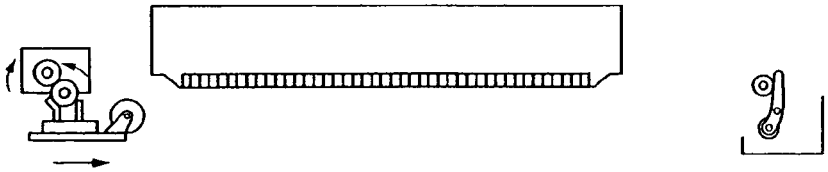

FIGS. 8F and 8G show the cleaning operations of the wipers 50, 51. FIG. 8F shows a state in which the wiper 50 is cleaned with the cleaning roller 57, FIG. 8F shows a state in which the wiper 51 is cleaned with the cleaning roller 57, and these states are substantially the same as those of FIGS. 3D and 3E.

Figure 8H:
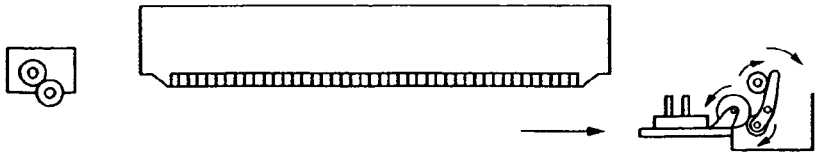

FIG. 8H shows an ink discharge operation for squeezing the ink from the absorbing roller 54. That is, after the operation of FIG. 8G, the wiper holder 52 is moved again to the position in the vicinity of the shown right end from the shown left side along the rail 53; and stopped in a position of FIG. 8H to enter the ink discharge operation in this position. The ink discharge operation and the constitution for the operation in FIG. 8H are substantially the same as those described with reference to FIG. 3B of the first embodiment. When the ink discharge operation of FIG. 8H ends, the motor 24 is driven to move the head holder 4 in the upward direction along the vertical guide 25, and accordingly the recording head 1 is moved upwards to return to the head cleaning standby state of FIG. 8A.

Thereafter, the cap 3 is moved to a position facing the discharge port surface of the recording head, the motor 24 is driven to move downwards the head holder 4, and the discharge port surface 2 of the recording head is brought into close contact with each cap 3 and brought into the capping state in which the recording head is protected as shown in FIG. 4. When the state is returned to the capping state, a series of head cleaning operation is completed. Alternatively, the apparatus may also enter a standby state while maintaining the head cleaning standby state as shown in FIG. 8A in preparation for the next head cleaning operation.

Third Embodiment

Figure 9:
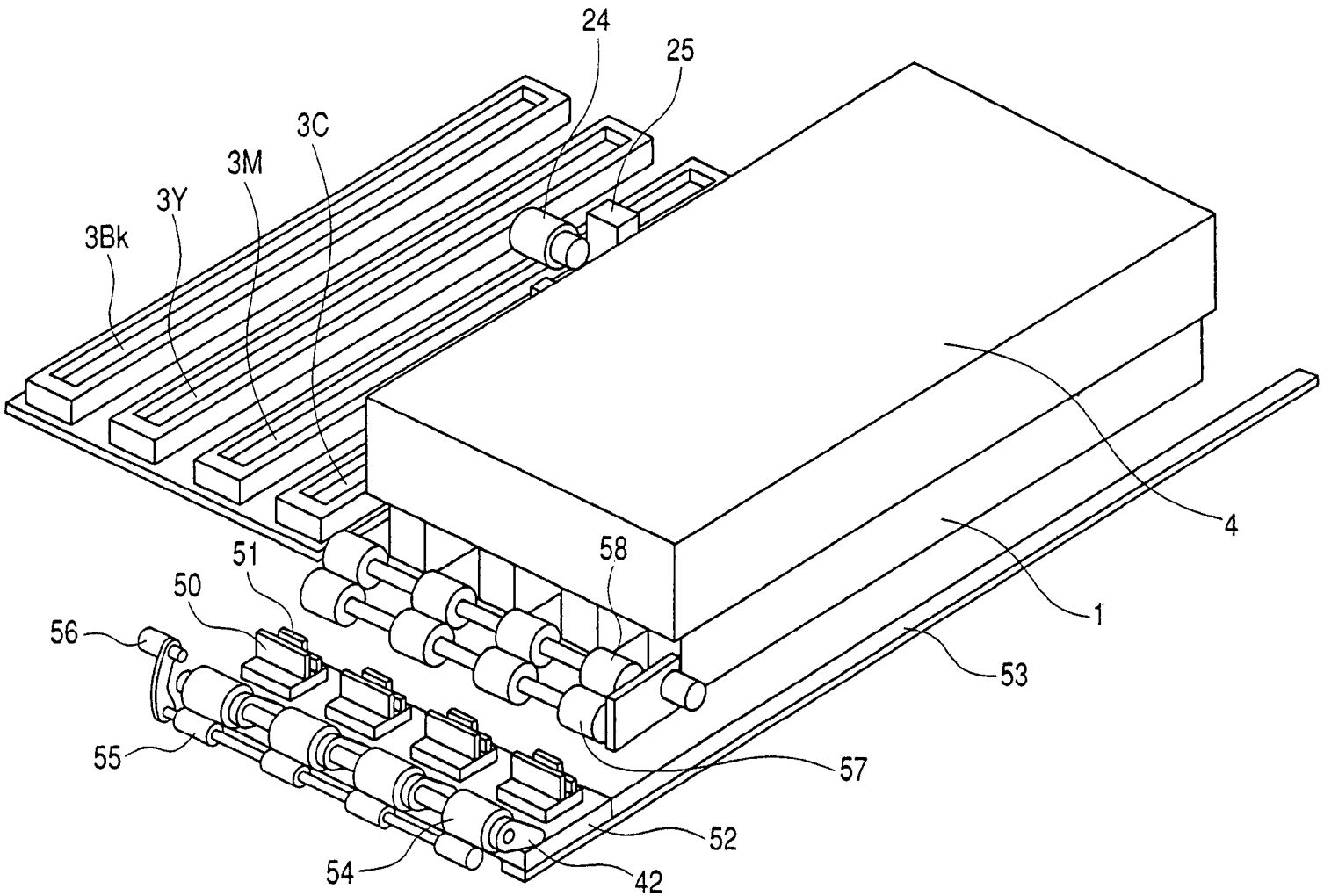
FIG. 9 is a schematic perspective view showing a state in which the cap is detached/retracted from the recording means in the recording means and the discharge port surface cleaning device in a third embodiment of the present invention.

FIG. 9 is a schematic perspective view showing a discharge port surface cleaning device in a third embodiment of the present invention together with recording means and caps, and FIGS. 10A to 10H are explanatory views showing a series of discharge port surface cleaning operation in the third embodiment-of the present invention. Also in the present embodiment, different respects from the first or second embodiment will be described in detail, but the parts which are not especially described are substantially the same as those of the embodiment. It is to be noted that in the present embodiment, as shown in FIGS. 9 and 10A to 10H, cleaning rollers 57, 58 and squeezing rollers 55, 56 are disposed on one side (right side of the drawing) of the recording head 1.

Figure 10A:
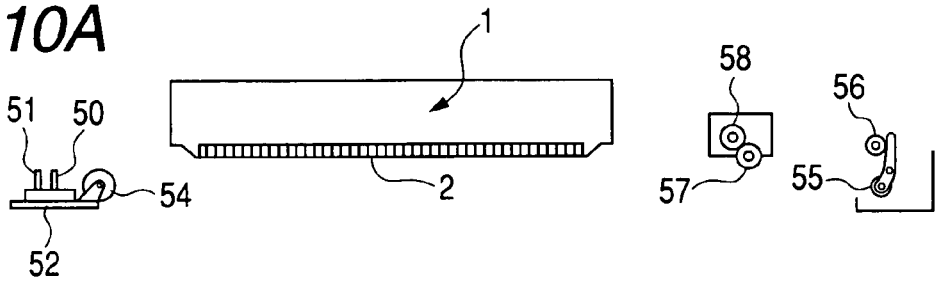
FIGS. 10A, 10B, 10C, 10D, 10E, 10F, 10G, and 10H are explanatory views showing a series of discharge port surface cleaning operation in the third embodiment of the present invention.
Figure 10B:
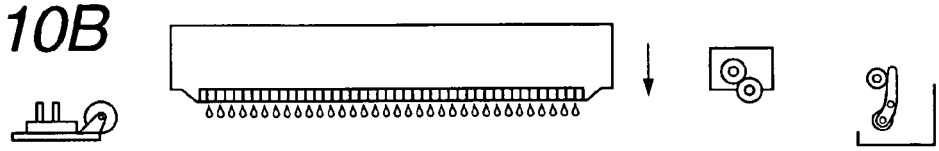

FIG. 10A shows a state of head cleaning standby, and the cap 3 is detached from the recording head 1 as shown in FIG. 9. In the present embodiment, the wiper holder 52 on which the absorbing roller 54 and the wipers 50, 51 are mounted is positioned on the shown left side of the recording head 1. Moreover, in the present embodiment, the process enters the ink pressurizing operation of the recording head 1 shown in FIG. 10B from the standby state of FIG. 10A.

Figure 10C:
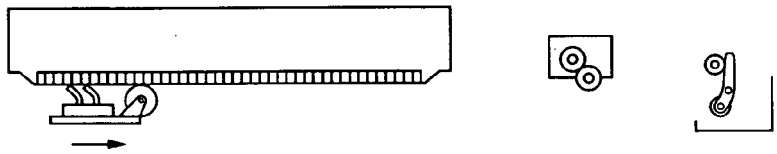

Next, when the motor 24 (FIG. 9) is driven to move downwards the head holder 4, the discharge port surface 2 of the recording head is set to a position where the surface can be wiped by the absorbing roller 54 and the wipers 50, 51. Moreover, as shown in FIG. 10C, while the wiper holder 52 is moved in the shown right direction to move the absorbing roller 54 and the wipers 50, 51 in the arrangement direction of discharge ports along the discharge port surface 2, the discharge port surface 2 is wiped (cleaned) by the absorbing roller and the wipers. The discharge port surface wiping operation in FIG. 10C is substantially the same as that of FIG. 3F or 8C, and after the ink pressurizing operation or the empty discharge operation, an ink wiping/absorbing operation and a sweeping/removing operation (wiping operation) of the discharge port surface are performed.

Figure 10D:
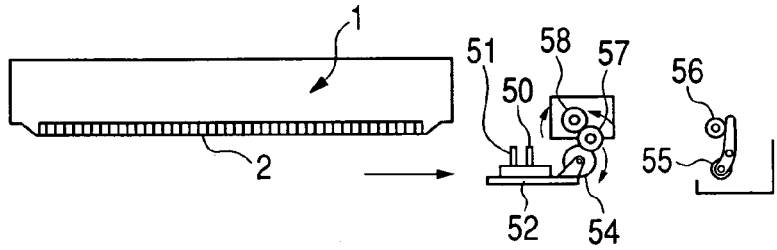
Figure 10E:
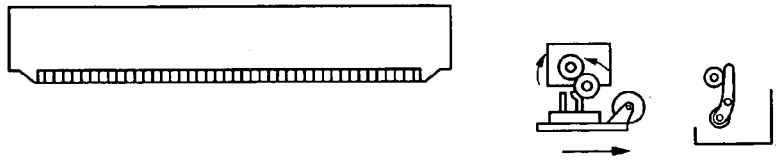
Figure 10F:
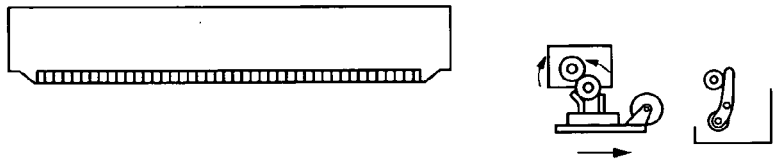

FIG. 10D shows a purifying operation for the cleaning roller 57. That is, the wiper holder 52 moves to the right of the drawing in the state of FIG. 10C, reaches a position on the left side as shown in FIG. 10D, and stops in the position to enter the purifying operation of the first cleaning roller 57. The purifying operation in FIG. 8D is substantially the same as that of FIG. 3C or 8E. FIGS. 10E, 10F show a cleaning operation of the wipers 50, 51. FIG. 10E shows a state in which the cleaning roller 57 is rotated/driven to clean the wiper 50, FIG. 10F shows a state in which the cleaning roller 57 is rotated/driven to clean the wiper 51, and these operations are substantially the same as those of FIGS. 3D and 3E or FIGS. 8F and 8G.

Figure 10G:
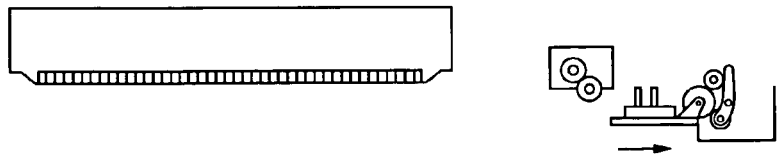
Figure 10H:
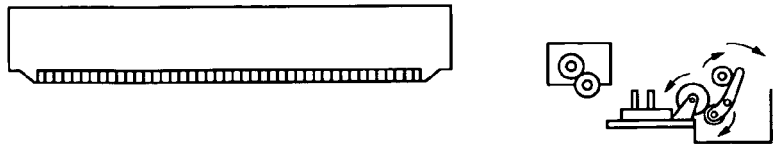

The wiper holder 52 moves further in the shown right direction from the state of FIG. 10F, and stops in a position shown in FIG. 10G to enter the next ink discharge operation shown in FIG. 10H. In the ink discharge operation in FIG. 10H, the ink is squeezed from the absorbing roller 54, and the operation content and the constitution for the operation are substantially the same as those of the ink discharge operation of FIG. 3B or 8H. When the ink discharge operation of FIG. 10H ends, the motor 24 is driven to move the head holder 4 in the upward direction along the vertical guide 25, and the recording head 1 is moved upwards to return to the head cleaning standby state of FIG. 10A.

Thereafter, the cap 3 is moved to a position facing the discharge port surface 2 of the recording head, the motor 24 is driven to move downwards the head holder 4, the discharge port surface 2 of each recording head is brought into close contact with each cap 3 and returned to the capping state in which the recording head is protected as shown in FIG. 4, and a series of head cleaning operation is completed. Alternatively, the apparatus may also enter a standby state while maintaining the standby state as shown in FIG. 10A in preparation for the next head cleaning operation.

According to the third embodiment of FIGS. 9 and 10A to 10H, since the cleaning rollers 57, 58 and the squeezing rollers 55, 56 are disposed on the same side (right side of the drawing) of the recording means, as compared with the above-described embodiments, the discharge port surface cleaning device, and further the recording apparatus can be further miniaturized, lightened, and simplified.

Fourth Embodiment

Figure 11:
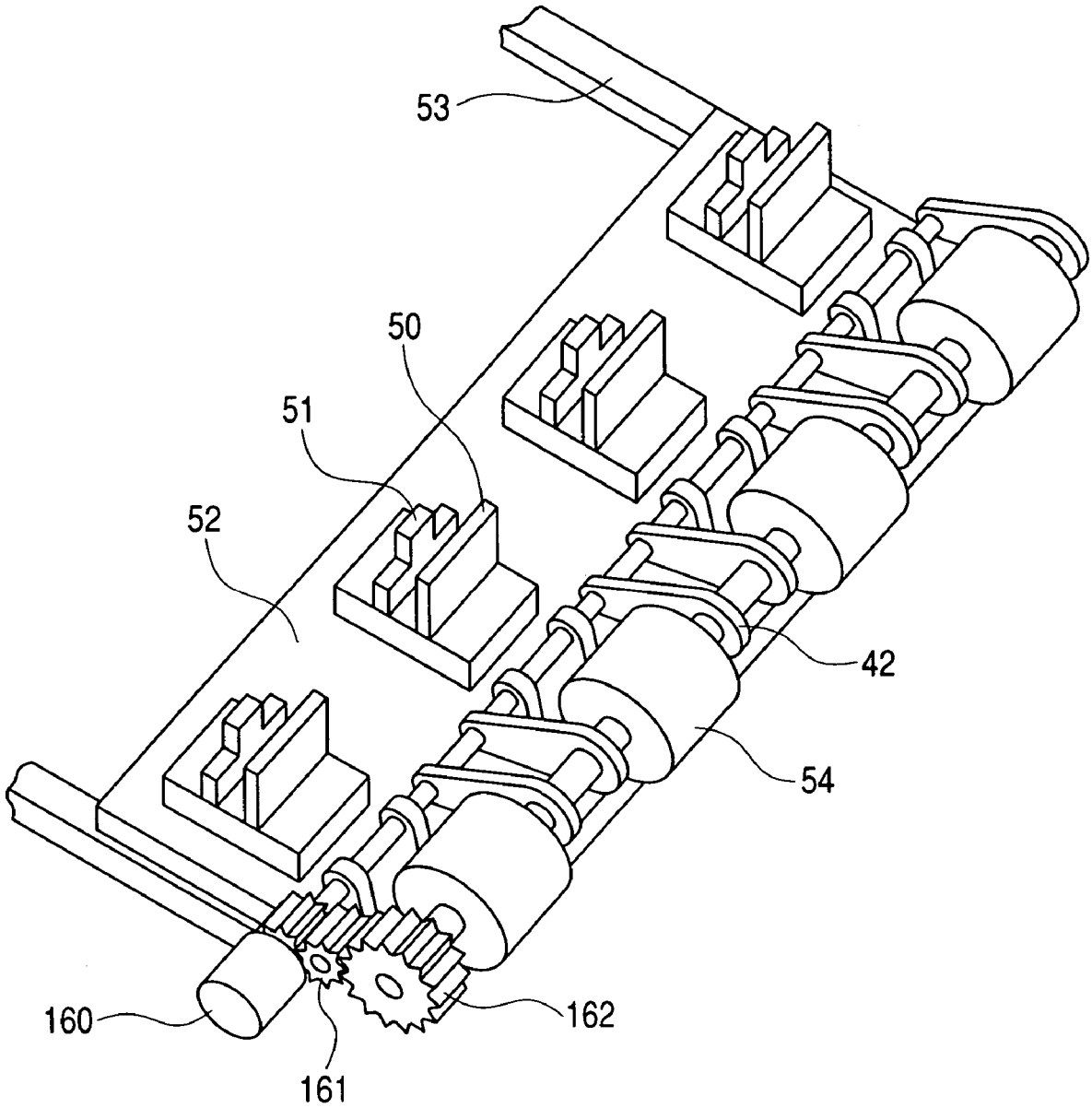
FIG. 11 is a schematic perspective view showing the discharge port surface cleaning device in a fourth embodiment of the present invention.
Figure 12A:
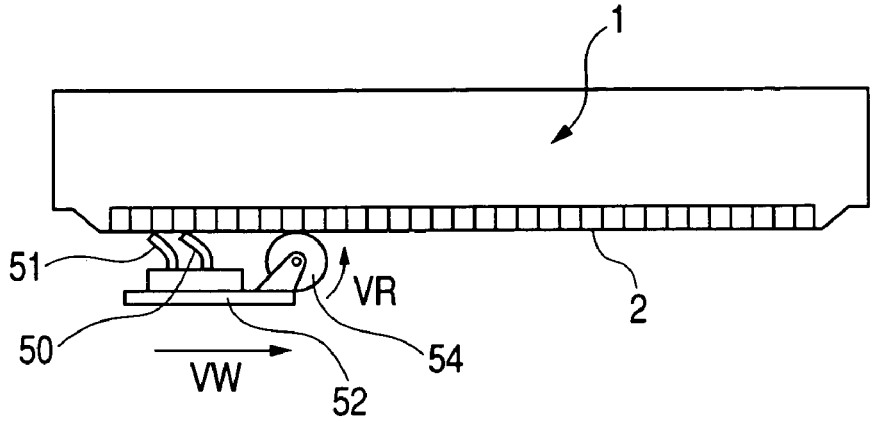
FIGS. 12A, 12B, and 12C are schematic perspective views showing the discharge port surface cleaning operation in the fourth embodiment of the present invention.
Figure 12B:
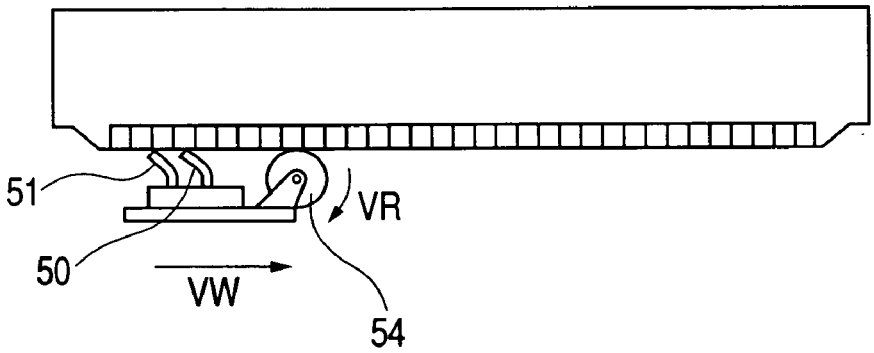
Figure 12C:
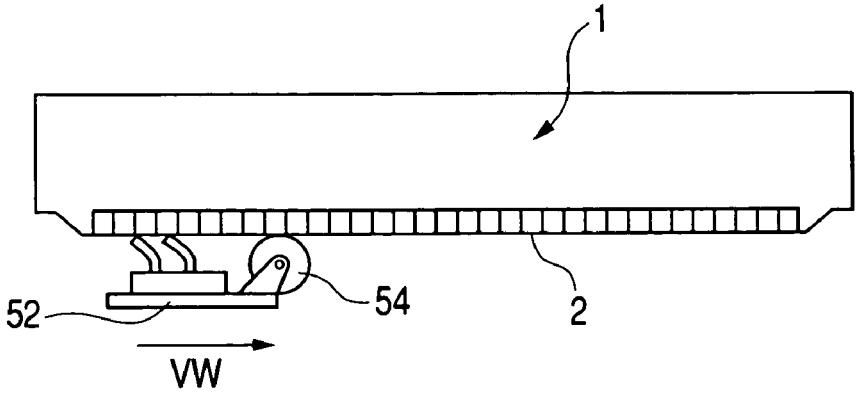
Figure 13:
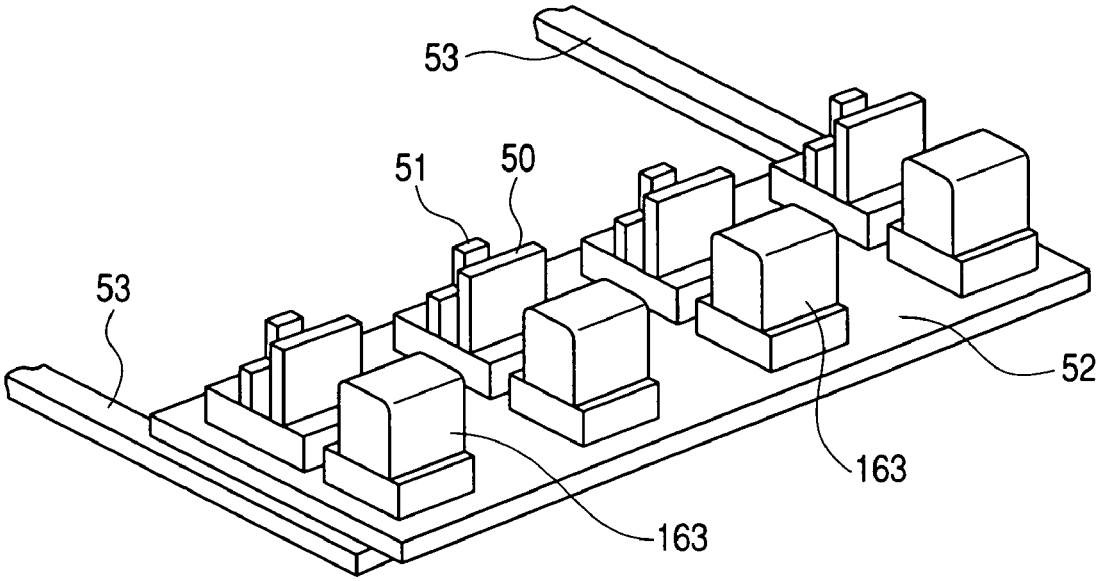
FIG. 13 is a schematic perspective view showing another constitution example of the discharge port surface cleaning device in the fourth embodiment of the present invention.

FIG. 11 is a schematic perspective view showing a constitution of the discharge port surface cleaning device in a fourth embodiment of the present invention, FIGS. 12A to 12C are explanatory views showing the discharge port surface cleaning operation by the absorbing roller and the wipers in the fourth embodiment of the present invention, and FIG. 13 is a schematic perspective view showing a modified constitution example of the discharge port surface cleaning device in the fourth embodiment of the present invention.

In the constitution of FIGS. 11 and 12A to 12C, driving means for rotating/driving the absorbing rollers 54 is disposed. That is, in FIG. 11, reference numeral 160 is a motor for rotating/driving the absorbing rollers 54, and 161, 162 denote driving gears for transmitting the driving of the motor 160 to the absorbing rollers 54. The absorbing rollers 54 are constituted so as to be rotated/driven in a forward/reverse direction by controlling a driving direction of the motor 160. In FIG. 12A to 12C, assuming that a moving speed of the wiper holder 52 is VW, a peripheral surface speed (surface speed) of a contact surface of the absorbing roller 54 with the discharge port surface 2 is VR, and a peripheral surface speed (relative speed) of the absorbing roller 54 with respect to the discharge port surface at this time is VH, a relation of VH=VW+VR is obtained. FIG. 12A shows a state in which the absorbing roller 54 is rotated/driven in a shown counterclockwise direction. Here, it is assumed that the shown right direction at VW is + direction, and the shown clockwise direction of the rotation at VR is + direction.

Then, for example, when the speed VW of the wiper holder 52 is 200 mm/sec, and the peripheral surface speed VR of the absorbing roller 54 is −100 mm/sec, the absorbing roller rotates in the shown counterclockwise direction (− direction) while moving at a discharge port surface wiping time. The relative speed (peripheral speed of the absorbing roller 54 with respect to the discharge port surface) VH at this time is "200−100=100 mm/sec." In this state, as shown in FIG. 12A, at the discharge port surface wiping time, the absorbing roller 54 frictionally slides on the discharge port surface 2 in the shown right direction while wiping.

Moreover, for example, when the speed VW of the wiper holder 52 is 200 mm/sec, and the peripheral surface speed VR of the absorbing roller 54 is −250 mm/sec, the relative speed VH with respect to the discharge port surface at this time is. "200−250=−50 mm/sec." In this state, the absorbing roller 54 frictionally slides on the discharge port surface in the shown left direction while wiping.

According to the constitutions and the speed settings, as compared with a case where the absorbing roller follows the movement to rotate with respect to the discharge port surface, it is possible to powerfully wipe/remove the ink, dust, nap, paper powder and the like attached to the discharge port surface 2. It is to be noted that, for example, when the speed VW of the wiper holder 52 is 200 mm/sec, and the peripheral surface speed VR of the absorbing roller 54 is −200 mm/sec, the relative speed VH with respect to the discharge port surface at this time is "200−200=0 mm/sec." In this state, since there is not any relative speed (no sliding friction) between the absorbing roller 54 and the discharge port surface 2, the wiping operation is performed in the same manner as in a case where the absorbing roller follows the movement to rotate with respect to the discharge port surface.

FIG. 12B shows a state in which the absorbing roller 54 is rotated/driven in a shown clockwise direction. Here, it is assumed that the shown right direction at the moving speed VW of the wiper holder 52 is + direction, and the shown clockwise direction of the rotation at the peripheral speed VR of the contact surface of the absorbing roller 54 with the discharge port surface 2 is + direction. Then, for example, when the speed VW of the wiper holder 52 is 200 mm/sec, and the peripheral surface speed VR of the absorbing roller 54 is +100 mm/sec, the absorbing roller at the discharge port surface wiping time rotates in the shown clockwise direction (+ direction) while progressing. The relative speed VH with respect to the discharge port surface at this time is "200+100=300 mm/sec." In this state, as shown in FIG. 12B, at the discharge port surface wiping time, the absorbing roller 54 frictionally slides on the discharge port surface 2 in the shown right direction while moving. Even in this case, as compared with the case where the absorbing roller follows the movement to rotate, the ink, dust, nap, paper powder and the like attached to the discharge port surface 2 can be powerfully wiped/removed.

FIG. 12C shows a state in which the absorbing roller 54 wipes the discharge port surface in a stopped state without rotating/driving the roller. Here, it is assumed that the shown right direction at the moving speed VW of the wiper holder 52 is + direction, and the shown clockwise direction of the rotation at the peripheral speed VR of the contact surface of the absorbing roller 54 with the discharge port surface 2 is + direction. Then, for example, when the speed VW of the wiper holder 52 is 200 mm/sec, and the peripheral surface speed VR of the absorbing roller 54 is 0 mm/sec (stopped state), the absorbing roller at the discharge port surface wiping time rotates in a state in which the rotation stops as shown. The relative speed VH of the peripheral surface of the roller 54 with respect to the discharge port surface at this time is "200+0=200 mm/sec."

In this state, as shown in FIG. 12C, the peripheral surface of the absorbing roller 54 frictionally slides on the discharge port surface 2 in the shown right direction with the moving speed VW of the wiper holder 52. Even in this case, as compared with the case where the absorbing roller follows the movement to rotate, the foreign matters such as the ink and dust attached to the discharge port surface 2 can be powerfully wiped/removed. Since the absorbing roller 54 does not rotate in this state, the state functions in the same manner as in a case where an ink absorbing member is a fixed member. FIG. 13 shows a constitution in a case where the ink absorbing members are absorbing members 163 having block shapes that do not rotate. It is to be noted that the discharge port surface cleaning device of FIG. 13 except the blocked absorbing members 163 has substantially the same constitution as that in the use of the rotatable absorbing rollers 54.

Even according to the fourth embodiment shown in FIGS. 11 to 13, the wiper holder 52 moves to the other end from one end along the discharge port row of the recording head, and the discharge port surface is wiped by the ink absorbing member and the wiper attached to the wiper holder 52, so that the foreign matters such as the ink attached to the discharge port surface can be removed. It is to be noted that when rotating/driving means of the absorbing roller 54 is disposed in the present embodiment, for example, at a usual time, VW=−VR is set in order to allow the roller to rotate with respect to the discharge port surface in a follower manner. The absorbing roller is rotated/driven and switched to frictionally slide at a desired relative speed depending on a degree of dirt on the discharge port surface, and a more preferable driving state can be selected in accordance with characteristics, situations and the like of the apparatus. In the movement in the rotation stop state, instead of the rotatable roller shape, arbitrary shapes such as a block shape may also be used in the ink absorbing member.

Fifth Embodiment

Figure 14:
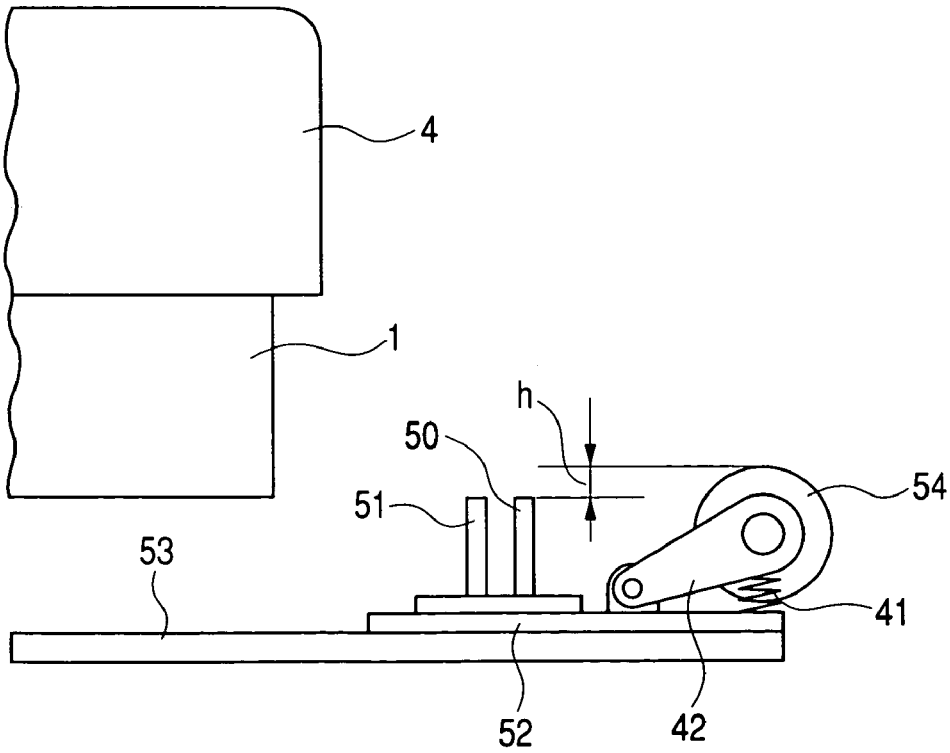
FIG. 14 is a schematic side view showing the discharge port surface cleaning device together with the recording means in a fifth embodiment of the present invention.

FIG. 14 is a schematic side view showing the discharge port surface cleaning device together with the recording means in a fifth embodiment of the present invention, and FIGS. 15A to 15J are explanatory views showing a series of discharge port surface cleaning operation in the fifth embodiment. Also in the present embodiment, different respects from the first to fourth embodiments will be described in detail, and parts that are not especially described are substantially the same as those of the embodiments. In the present embodiment, the cleaning rollers 57, 58 and the squeezing rollers 55, 56 are disposed on one side.

Figure 15A:
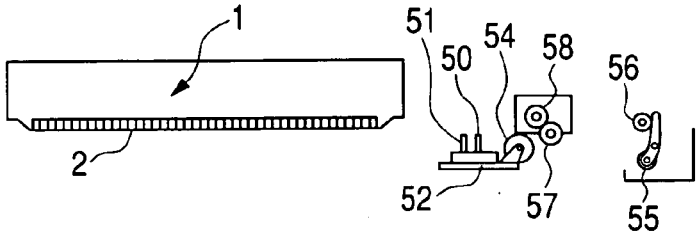
FIGS. 15A, 15B, 15C, 15D, 15E, 15F, 15G, 15H, 15I, and 15J are explanatory views showing a series of discharge port surface cleaning operation in the fifth embodiment of the present invention.
Figure 15B:
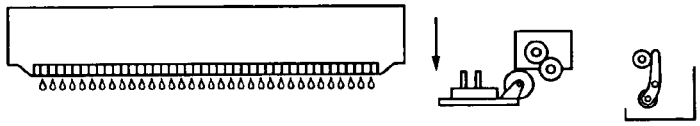

FIG. 15A shows a head cleaning standby state, and the cap 3 is detached from the recording head 1 as shown in FIG. 9. In the state of FIG. 15A, the wiper holder 52 on which the absorbing roller 54 and the wipers 50, 51 are mounted is positioned on the shown right side. Moreover, an ink pressurizing operation of the recording head 1 shown in FIG. 15B is performed from the standby state.

Figure 15C:
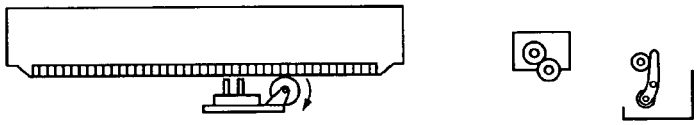

Next, when the motor 24 (FIG. 9) is driven to move downwards the head holder 4, the discharge port surface 2 is set to a position where the surface can be cleaned by the absorbing roller 54. Moreover, as shown in FIG. 15C, while the wiper holder 52 is moved in a shown left direction, the discharge port surface 2 is wiped by the absorbing roller 54. In the state of FIG. 15C, the wiper does not contact the discharge port surface. Also in the present embodiment, as shown in FIG. 14, the absorbing roller 54 is attached via the compression spring 41 disposed between the roller and the wiper holder 52 so that the roller can be pressed downwards, and a contact force with respect to the discharge port surface 2 is obtained by a spring elastic force. In a usual state, as shown in FIG. 14, the wipers 50, 51 have heights different from those of the absorbing rollers 54, and the wiper is constituted to be lower than the absorbing roller by a height h.

Therefore, in FIG. 15C, when the wiper holder 52 moves in the shown left direction, only the absorbing roller contacts the discharge port surface 2, and the wipers move in a detached state from the discharge port surface. On the other hand, the absorbing roller 54 does not have any driving means in the rotation direction, and is constituted to be freely rotatable. The roller rotates following a contact movement force with respect to the discharge port surface, and wipes/absorbs the ink or the like without frictionally sliding on the discharge port surface.

Figure 15D:
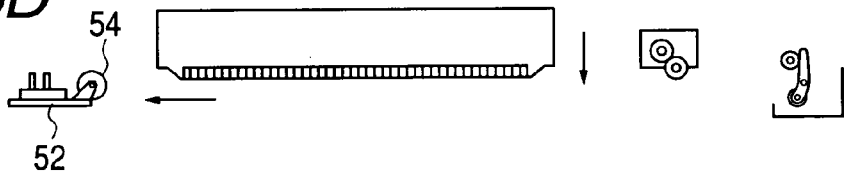

FIG. 15D shows a wiper holder stopped state after the discharge port surface wiping operation of FIG. 15C. That is, the wiper holder 52 moves to the vicinity of the shown left end portion by the discharge port surface wiping operation of FIG. 15C, and is stopped in a left-side position shown in FIG. 15D.

Figure 15E:
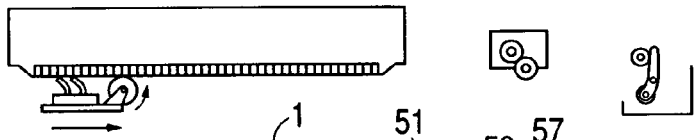

Next, as shown in FIG. 15E, while the wiper holder 52 is moved in a shown right direction, an operation (wiping mode) is performed to wipe the discharge port surface by the absorbing roller 54 and the wipers 50, 51. That is, after the wiping operation of FIG. 15C, while the wiper holder stops in FIG. 15D, the recording head 1 is moved downwards by a predetermined distance. Accordingly, the absorbing roller 54 and the wipers 50, 51 are brought into contact with the discharge port surface with predetermined overlap amounts (invasion amounts). Next, as shown in FIG. 15E, while the wiper holder is moved in the shown right direction, the discharge port surface is wiped by both the absorbing roller and the wiper.

When both functions of ink absorbing and wiping are combined by the reciprocating movement of the wiper holder 52 in this manner, it is possible to perform an efficient discharge port surface cleaning operation, and even a long and broad discharge port surface can be cleaned with good efficiency as in the recording head of the longitudinal full-line type.

Figure 15F:
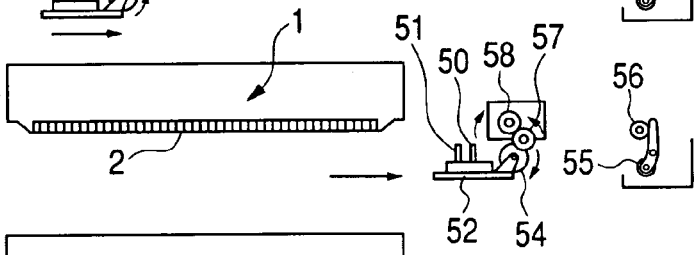

FIG. 15F shows the purifying operation for the cleaning roller 57. After moving the wiper holder 52 in the shown right direction in the operation of FIG. 15E, the wiper holder is stopped in a position on the right side as shown in FIG. 15F. The absorbing roller 54 is brought into contact with the cleaning roller 57 to rotate/drive the cleaning roller 57, and accordingly the purifying operation of the cleaning roller 57 is executed. The purifying operation and the constitution for the operation are substantially the same as those in FIG. 13C or 10D.

Figure 15G:
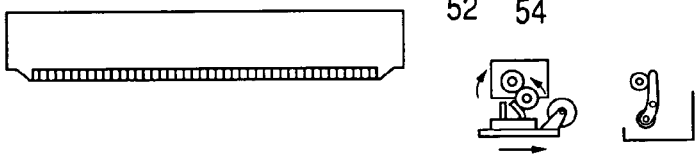
Figure 15H:
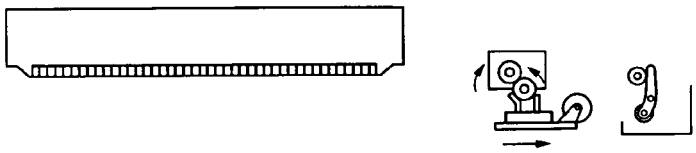

FIGS. 15G, 15H show the cleaning operations of the wipers 50, 51. When the purifying operation of the cleaning roller 57 in FIG. 15F ends, the wiper holder 52 is moved in the shown right direction by a predetermined distance to a position of FIG. 15G, the wiper 50 is brought into contact with the cleaning roller 57 in the position of FIG. 15G to rotate/drive the cleaning roller 57, and the wiper 50 is cleaned. Moreover, after the elapse of a certain cleaning time, the wiper holder 52 is further moved in the shown right direction by a predetermined distance to a position of FIG. 15H, the wiper 51 is brought into contact with the cleaning roller 57 in the position of FIG. 15H, and the cleaning roller 57 is rotated/driven to clean the wiper 51. Moreover, after the elapse of a certain cleaning time, the driving of the cleaning roller 57 is stopped. These wiper cleaning operations and the constitutions for the operations are substantially the same as those in FIGS. 3D, 3E or FIGS. 10E, 10F.

Figure 15I:
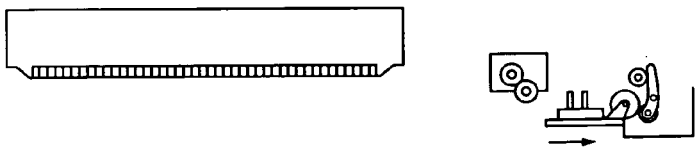
Figure 15J:
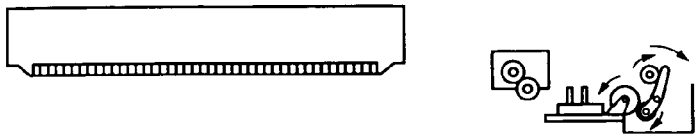

The wiper holder 52 is further moved in the shown right direction from the state of FIG. 15H to stop the absorbing roller 54 in the vicinity of or in contact with the squeezing roller 55 as shown in FIG. 15I. Next, in this position, as shown in FIG. 15J, the squeezing cam 56 is rotated to allow the squeezing roller 55 to abut on the absorbing roller 54 with a predetermined pressing force. Moreover, the squeezing roller 55 is rotated/driven to squeeze the ink from the absorbing roller 54. The ink discharge operation is performed in this manner.

The operation of squeezing the ink from the absorbing roller 54 in FIG. 15J (ink discharge operation) and the constitution for the operation are substantially the same as those in the operation of FIG. 3B or 10H. When the ink discharge operation of FIG. 15J ends, the head holder 4 is moved in the upward direction along the vertical guide 25 by the driving of the motor 24, and the recording head 1 is moved upwards to return to the head cleaning standby state of FIG. 15A. Thereafter, the cap 3 is moved in a horizontal direction and set in a position facing the discharge port surface of the recording head. Moreover, the motor 24 is driven to move downwards the head holder 4, the discharge port surface 2 of each recording head is closely attached to each cap 3 to return the capping state in which the recording head is protected as shown in FIG. 4, and a series of discharge port surface cleaning operation is completed. Alternatively, the apparatus may also enter a standby state while maintaining the standby state as shown in FIG. 15A in preparation for the next head cleaning operation.

The above-described fifth embodiment includes: a wiping mode in which only the absorbing roller 54 abutting on the discharge port surface 2 is moved in the arrangement direction of discharge ports to remove the foreign matters such as the ink attached to the discharge port surface; and a sweeping mode in which the absorbing roller 54 and the wipers 50, 51 abutting on the discharge port surface 2 are moved in the arrangement direction of discharge ports to remove the foreign matters such as the ink attached to the discharge port surface. According to the constitution, without changing any constitution of the discharge port surface cleaning-device, a time interval can be disposed between a wiping/absorbing by the absorbing roller in FIG. 15C and the sweeping operation by the wiper in FIG. 15E, and accordingly a cleaning performance with respect to the discharge port surface can be enhanced.

It is to be noted that in the ink jet recording head, the discharge port surface is subjected to a water-repellent treatment in many cases. Usually, to prevent the ink from leaking (sagging) from the discharge ports, a state in which a certain negative pressure is applied onto the discharge port surface is held. In the recording head constituted in this manner, when the ink discharged by the ink pressurizing operation and attached to the discharge port surface is wiped/absorbed by the absorbing roller as shown in FIG. 15B, a behavior of the ink on the wiped discharge port surface indicates a very fluid behavior until the elapse of a certain time. Concretely, for example, in the discharge port surface subjected to the water-repellent treatment, a behavior is indicated in which fine ink particles gradually aggregate with the elapse of time. When the discharge ports are kept in a negative pressure state, the ink remaining on the discharge port surface after the wiping/absorbing by the absorbing roller sometimes indicates a behavior in which the ink is absorbed into the discharge ports with the elapse of time.

From these situations, a case can be admitted in which the discharge port surface is wiped with a certain time interval after wiping/absorbing the ink as in the present embodiment, so that a cleaning performance (wiping/removing performance) can be enhanced. Moreover, according to the present embodiment, for a purpose of enhancing the cleaning performance, there can be provided a discharge port surface cleaning operation capable of freely setting a time interval between the ink absorbing operation and the wiping operation to an appropriate time. An appropriate value of the time interval between the ink absorbing operation and the wiping operation is also influenced by the recording head for use, the constitution of an ink supply system, the use situation of the head cleaning device, the state of the discharge port surface and the like. It is to be noted that as the case may be, it is sometimes effect to substantially simultaneously perform the ink absorbing operation and the wiping operation without disposing any time interval. Even this case can be easily handled according to the present embodiment.

Sixth Embodiment

Figure 16:
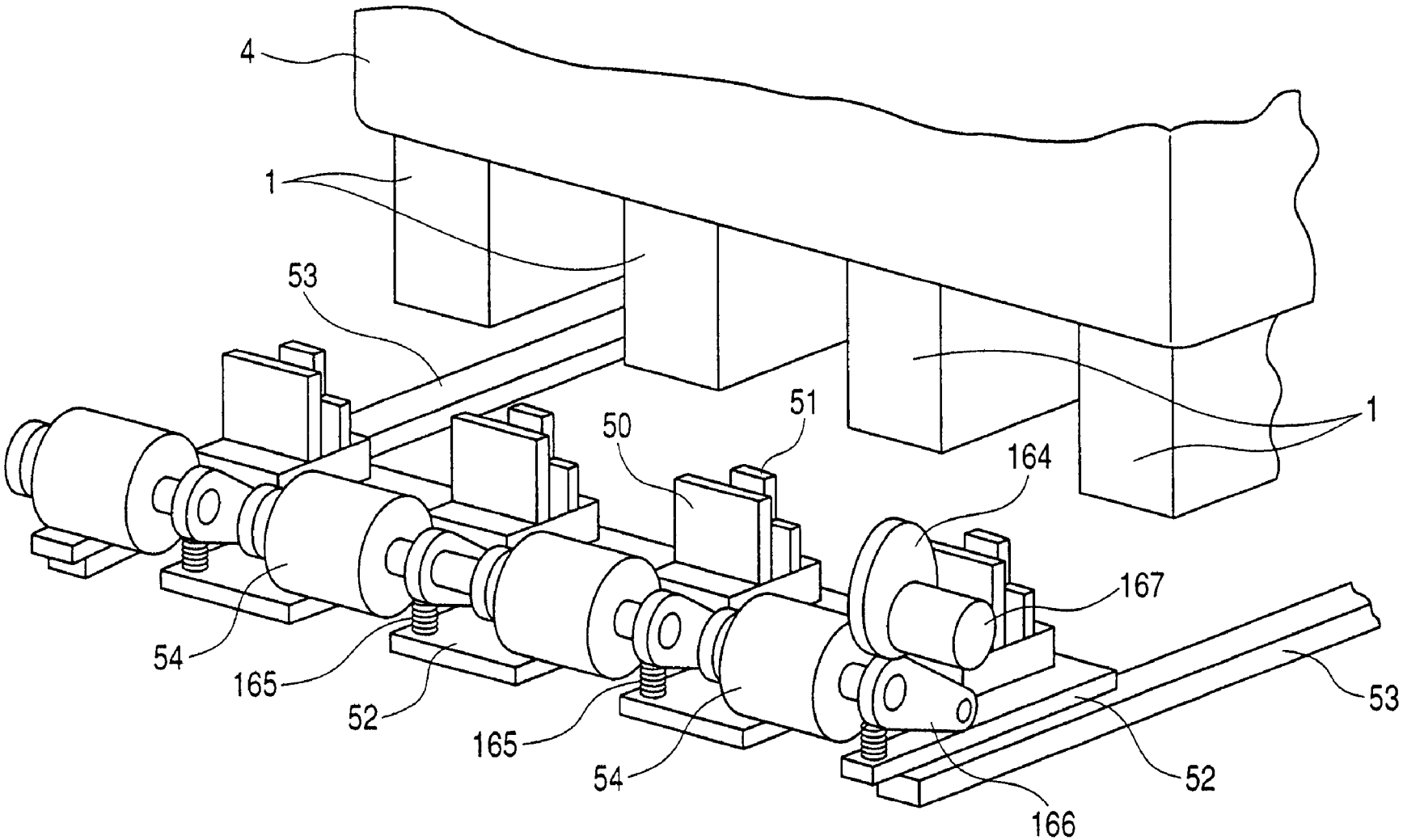
FIG. 16 is a schematic perspective view showing the discharge port surface cleaning device together with the recording means in a sixth embodiment of the present invention.

FIG. 16 is a schematic perspective view showing the discharge port surface cleaning device together with the recording means in a sixth embodiment of the present invention, and FIGS. 17A to 17K are explanatory views showing a series of discharge port surface cleaning operation in the sixth embodiment of the present invention. Also in the present embodiment, different respects from the above-described embodiments will be described in detail, and parts that are not especially described are substantially the same as those of the embodiments. In the present, embodiment, wiper cleaning means 57, 58 and squeezing rollers 55, 56 are disposed on one side of the recording head 1.

Figure 17A:
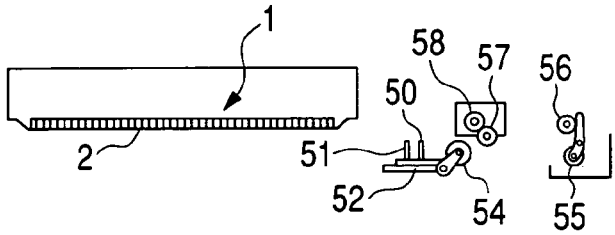
FIGS. 17A, 17B, 17C, 17D, 17E, 17F, 17G, 17H, 17I, 17J, and 17K are explanatory views showing a series of discharge port surface cleaning operation in the sixth embodiment of the present invention.

FIG. 17A shows a head cleaning standby state, and the cap 3 is detached as shown in FIG. 9. In the state of FIG. 17A, the wiper holder 52 is positioned on the shown right side of the recording head 1. An ink pressurizing operation of the recording head 1 shown in FIG. 17B is performed from the standby state of FIG. 17A.

Figure 17B:
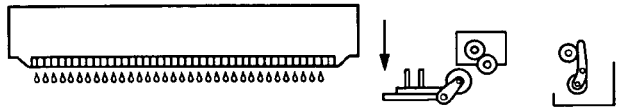
Figure 17C:
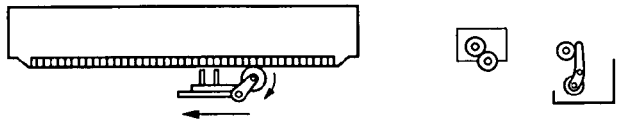

After ending the ink discharge operation in FIG. 17B, when the motor 24 (FIG. 9) is driven to move downwards the head holder 4, the discharge port surface 2 is set to a position where the surface can be wiped by the absorbing roller 54. Moreover, as shown in FIG. 17C, while the wiper holder 52 is moved, the discharge port surface is wiped by the absorbing roller 54. In the present embodiment, as shown in FIG. 16, absorbing roller detaching means is disposed for adjusting the height of the absorbing roller 54 mounted on the wiper holder 52 with respect to the discharge port surface 2 (connecting/disconnecting).

In FIG. 16, reference numeral 164 denotes an absorbing roller driving cam, 165 denotes a return spring (reactive force spring), 166 denotes a rocking arm, and 167 denotes a motor. The absorbing roller 54 is rotatably attached to the rocking arm 166. A surface to be driven of the rocking arm 166 is pressed onto a cam surface of the driving cam 164 by an elastic force of the spring 165. That is, for example, when the driving cam 164 is rotated by the motor 167, the vertical direction position of the absorbing roller 54 is controllable via the rocking arm 166. The absorbing roller detaching means is constituted for detaching the absorbing roller 54 from the discharge port surface 2, when the absorbing roller and the wiper are moved along the discharge port surface.

In the state of FIG. 17C, the height of the discharge port surface 2 is set to a height position where the surface does not contact the wipers 50, 51 on the wiper holder. Moreover, the position of the absorbing roller 54 is regulated to a height in which the roller can contact the discharge port surface with a desired overlap amount by the driving cam 164. Therefore, when the wiper holder 52 is moved in a shown left direction, only the discharge port surface wiping operation by the absorbing roller is performed. The absorbing roller 54 does not include any driving means in a rotation direction, is constituted to be freely rotatable, and is rotated by a contact movement force with respect to the discharge port surface in a follower manner.

Figure 17D:
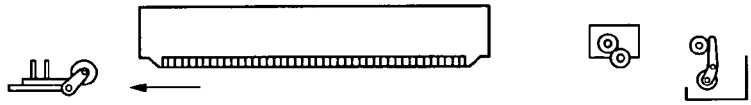
Figure 17E:
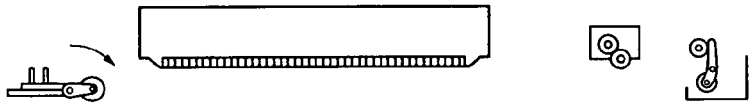

FIG. 17D shows a state in which the wiper holder 52 is stopped in the position on the shown left side after ending the discharge port surface wiping operation of FIG. 17C. That is, while the wiper holder 52 is moved in the shown left direction, the discharge port surface wiping/absorbing operation is performed. Thereafter, as shown in FIG. 17D, the wiper holder 52 is moved to the position in the vicinity of the left end portion, and stopped. FIG. 17E shows a detaching operation of the absorbing roller 54. That is, when the wiper holder is stopped in a position of FIG. 17D, the driving cam 164 is rotated/driven by the motor 167, accordingly the rocking arm 166 abutting on the cam surface is moved (rocked) in a downward direction against the spring 165, and the absorbing roller 54 is moved downwards to a position where the roller does not contact the discharge port surface as shown in FIG. 17E. That is, when the absorbing roller 54 and the wipers 50, 51 are moved along the discharge port surface 2, the absorbing roller is set in a position detached from the discharge port surface.

Figure 17F:
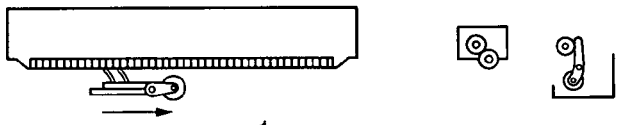

FIG. 17F shows a discharge port surface sweeping operation by the wipers 50, 51. That is, after the discharge port surface wiping operation of FIG. 17D, the discharge port surface is moved downwards to a position where the surface can contact with a predetermined invasion amount. Moreover, the absorbing roller is detached to a position where the roller does not contact the discharge port surface as shown in FIG. 17E. Subsequently, in FIG. 17F, while the wiper holder 52 is moved in the shown right direction, the discharge port surface is wiped only by the wiper. Also in the present embodiment, when a desired waiting time T is disposed between the ink absorption in, FIG. 17C and the wiping in FIG. 17F, even a long and broad discharge port surface can be cleaned with good efficiency as in the recording head of the full-line type.

Figure 17G:
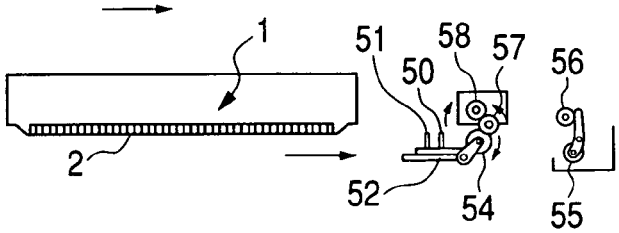

The wiper holder 52 moves in the shown right direction from the state of FIG. 17F, and stops in a position on the right side as shown in FIG. 17G to enter the purifying operation of the cleaning roller 57 in this position. FIG. 17G shows the purifying operation of the cleaning roller 57. That is, when the wiper holder 52 stops in a position of FIG. 17G, the driving cam 164 is again driven to move upwards the absorbing roller 54 to a position contacting the surface of the cleaning roller 57, and the cleaning roller 57 enters the purifying operation in this state. The purifying operation in FIG. 17G and the constitution for the operation are substantially the same as those in FIG. 3C or 15F.

Figure 17H:
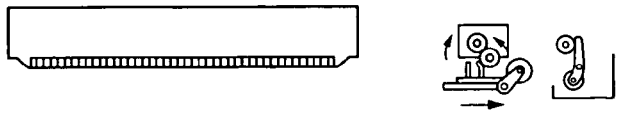
Figure 17I:
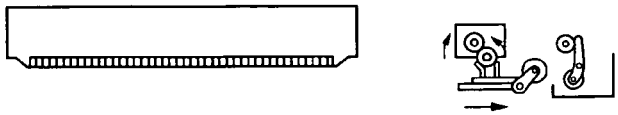

FIGS. 17H, 17I show the cleaning operations of the wipers 50, 51. When the purifying operation of the roller 57 in FIG. 17G ends, the wiper holder 52 is moved in the shown right direction by a predetermined distance to a position of FIG. 17H, and in this position the cleaning roller 57 is driven to clean the wiper 50. Moreover, after ending the cleaning of the wiper 50, the wiper holder 52 is further moved in the shown right direction to a position of FIG. 17I, and the cleaning roller 57 is driven in this position to clean the wiper 51. Thereafter, the driving of the cleaning roller 57 is stopped. These operations and the constitutions for the operations in FIGS. 17H, 17I are substantially the same as those in FIGS. 3D, 3E or FIGS. 15G, 15H.

Figure 17J:
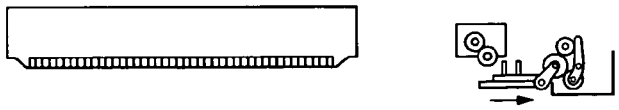
Figure 17K:
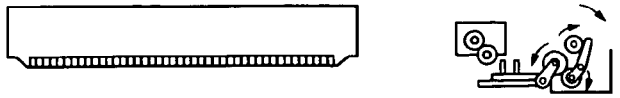

The wiper holder 52 is further moved in the shown right direction from the state of FIG. 17I by a predetermined amount, and is stopped in a position of FIG. 17J to perform the next ink discharge operation of FIG. 17K in this position. That is, FIGS. 17J, 17K show the ink discharge operation for squeezing the ink from the absorbing roller 54 by the squeezing roller 55, and the ink discharge operation and the constitution for the operation in FIGS. 17J, 17K are substantially the same as those in FIGS. 15F, 15J or FIGS. 3A, 3B. The ink squeezing operation from the absorbing roller 54 is performed by ink discharge means including the squeezing roller 55 and the squeezing cam 56.

When the ink discharge operation of FIG. 17K ends, the head holder 4 is moved in the upward direction along the vertical guide 25 by the driving of the motor 24, and the recording head 1 is moved upwards to return to the head cleaning standby state of FIG. 17A. Thereafter, the cap 3 is moved in the horizontal direction and set in a position facing the discharge port surface, the motor 24 is driven to move downwards the head holder 4, accordingly the discharge port surface 2 of each recording head is closely attached to each cap 3 to return to the capping state in which the recording head is protected as shown in FIG. 4, and a series of discharge port surface cleaning operation is completed. Alternatively, the apparatus may also enter a standby state while maintaining the standby state as shown in FIG. 17A in preparation for the next head cleaning operation.

In the sixth embodiment described above, the absorbing roller detaching means is disposed for detaching the absorbing roller 54 from the discharge port surface 2, when moving the absorbing roller and wiper along the discharge port surface. Accordingly, an ink jet recording apparatus is constituted including: a wiping mode in which only the absorbing roller is allowed to abut on the discharge port surface and is moved in the arrangement direction of the discharge ports to remove the foreign matters such as the ink attached to the discharge port surface; and a sweeping mode in which only the wipers are allowed to abut on the discharge port surface and are moved in the arrangement direction of the discharge ports to remove the foreign matters such as the ink attached to the discharge port surface. Even in the present embodiment, when the discharge port surface is wiped by both the absorbing roller and the wiper, the absorbing roller is operated ahead of the wiper.

According to the sixth embodiment of FIGS. 16 and 17A to 17K, since the detaching means for controlling the height position of the absorbing roller 54 is disposed in a series of discharge port surface cleaning operation, a desired time interval is disposed between the wiping/absorbing operation in FIG. 17C and the wiping operation in FIG. 17F, and the cleaning performance of the discharge port surface can be enhanced. That is, a function/effect similar to that described in the fifth embodiment can be achieved with respect to the ink aggregating behavior in the discharge port surface subjected to the water-repellent treatment with the elapse of time.

Even in the sixth embodiment described above, since the cleaning rollers 57, 58 and the squeezing rollers 55, 56 are disposed on the same side, the apparatus constitution can be miniaturized, lightened, and simplified. Since only the discharge port surface wiping operation is preferentially performed before the recording, a time until the start of the recording can be reduced while performing a head cleaning process. In this case, after ending the recording operation, the purifying operation of the cleaning roller 57, the cleaning operation of the wiper, and the ink discharge operation may also be performed. Moreover, the series of cleaning operation and the constitution for the operation are not limited to the shown constitutions, and may also effectively be combined appropriately and performed including the respective embodiments. It is to be noted that the absorbing roller 54 is moved downwards to a position where the roller does not contact the discharge port surface 2 even at the time of the operation of FIG. 17C, and a sequence may also be used in which only the wipers 50, 51 are used and the absorbing roller 54 is not used in a series of cleaning operation of the discharge port surface 2.

Seventh Embodiment

Figure 18:
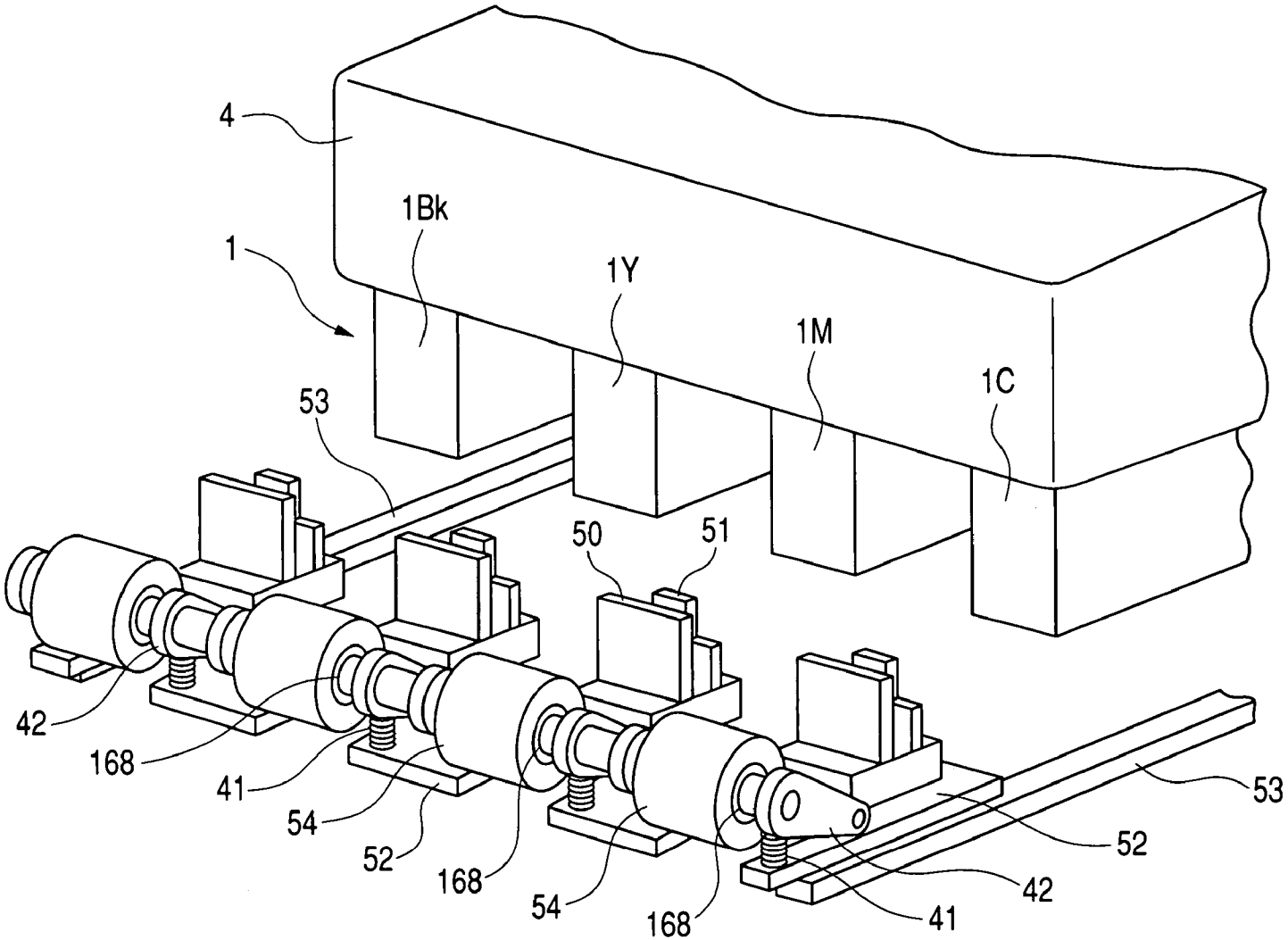
FIG. 18 is a schematic perspective view showing the discharge port surface cleaning device together with the recording means in a seventh embodiment of the present invention.
Figure 19A:
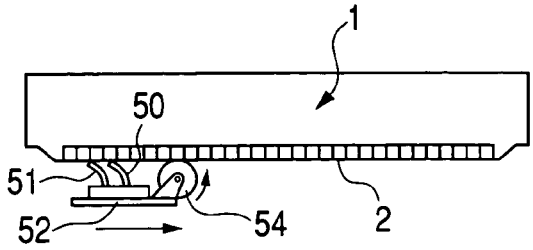
FIGS. 19A and 19B are explanatory views showing the discharge port surface cleaning operation in the seventh embodiment of the present invention.
Figure 19B:
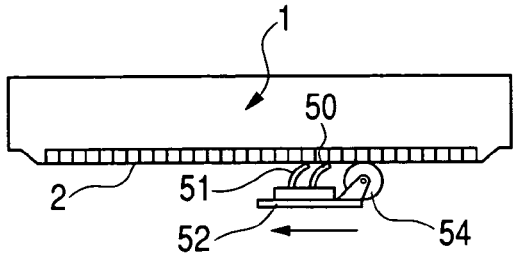

FIG. 18 is a schematic perspective view showing the discharge port surface cleaning device together with the recording means in a seventh embodiment of the present invention, and FIGS. 19A, 19B are explanatory views showing the discharge port surface cleaning operation in the seventh embodiment of the present invention. Also in the present embodiment, different respects from the above-described first to sixth embodiments will be described in detail, and parts that are not especially described are substantially the same as those of the embodiments.

In the embodiment, as shown in FIG. 18, one-way clutches 168 are attached to a driving shaft of the absorbing rollers 54. Accordingly, the one-way clutches 168 are brought into a locked state in a follower rotation direction of the absorbing rollers 54 at a time when the wiper holder 52 is moved in the left direction of FIGS. 19A, 19B, and the absorbing rollers 54 are stopped from rotating in the shown clockwise direction. The one-way clutches 168 are brought into a unlocked state in the follower rotation direction of the absorbing rollers 54 at a time when the wiper holder 52 is moved in the right direction of FIGS. 19A, 19B, and the absorbing rollers 54 are freely rotatable in the shown counterclockwise direction.

As described above, according to the seventh embodiment of FIGS. 19A, 19B, the wiping function of the discharge port surface can be changed in accordance with the moving direction of the wiper holder 52, and can be appropriately selected in accordance with a situation of dirt on the discharge port surface. That is, as compared with the absorbing roller 54 rotates in the follower manner during the wiping (in a state of a relative speed=0), the cleaning performance is enhanced in a case where the rotation is stopped (locked) to perform the wiping. For example, the cleaning operation is performed in a direction of follower rotation shown in FIG. 19A at a usual time, and the cleaning operation is performed in a direction in which the rotation is stopped (locked) as shown in FIG. 19B depending on a situation of dirt on the discharge port surface. It is possible to select conditions (functions) of a preferable cleaning operation if necessary or in accordance with the characteristics or use situations of the apparatus.

It is to be noted that in the present embodiment, the directions of rotation regulation (lock) and free rotation (unlock) of the absorbing roller 54 may be set to directions reverse to those of FIGS. 19A, 19B. By combination with the moving direction of the wiper holder 52, the function of the discharge port surface cleaning operation can be selectively set. Also when the preceding/following order of the absorbing roller and the wiper is combined with respect to the rotation regulation direction of the one-way clutches 168, the function of the discharge port surface cleaning operation can be selected. That is, the discharge port surface cleaning operation shown in FIGS. 19A, 19B show an example of the combination. For example, when the absorbing roller 54 is preceded, the rotation is regulated (locked), and the wiping operation may be performed in various modes if necessary. Furthermore, the wipers 50, 51 and the absorbing roller 54 are arranged such a positional relation that only the absorbing rollers 54 whose rotations are regulated (locked) by the one-way clutches 168 abut on the discharge port surface 2 and the wipers 50, 51 do not contact the discharge port surface 2. Accordingly, in FIG. 19B, the cleaning only by the absorbing roller 54 whose rotation is regulated (locked) may also be performed.

Figure 20A:
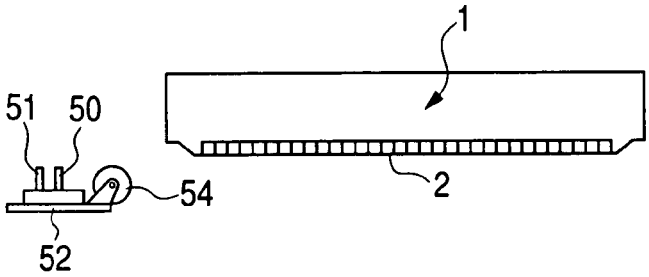
FIGS. 20A, 20B, 20C, and 20D are explanatory views showing the discharge port surface cleaning operation in an eighth embodiment of the present invention.
Figure 20B:
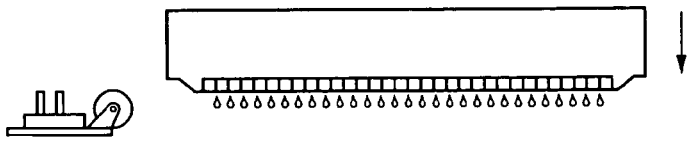

FIGS. 20A to 20D are explanatory views showing the discharge port surface cleaning operation in an eighth embodiment of the present invention. Also in the present embodiment, mainly a different respect from the first embodiment will be described, and parts that are not especially described are substantially the same as those of the first or third embodiment. FIG. 20A shows a head cleaning standby state, the cap 3 is detached from the recording head 1, and the wiper holder 52 is disposed in a position on the shown left side of the recording head 1. An ink pressurizing operation in FIG. 20B is performed from the standby state in FIG. 20A.

Figure 20C:
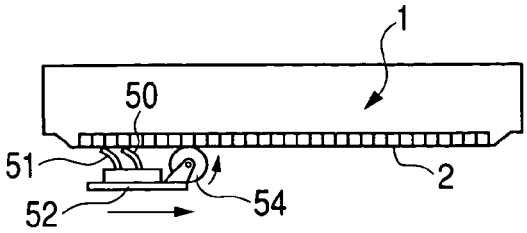

In FIG. 20B, when the motor 24 is driven to move downwards the head holder 4 after the ink pressurizing operation, the discharge port surface is set to a position where the surface can be wiped by the absorbing roller and the wipers. Moreover, as shown in FIG. 20C, while the wiper holder 52 is moved in the shown right direction along the rail 53, the ink is wiped/absorbed by the preceding absorbing roller 54 to enter the wiping operation for the sweeping/removing by the following wipers 50, 51. The sweeping operation and the constitution for the operation in FIG. 20C are substantially the same as those in FIG. 3F or 10C.

Figure 20D:
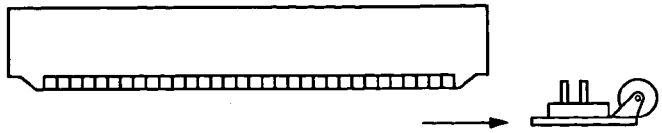

When the wiper holder 52 moves in the shown right direction and reaches the right side in the sweeping operation of FIG. 20C, this is detected by a sensor (not shown), and the wiper holder 52 is stopped in a position in the vicinity of the right end portion as shown in FIG. 20D. Moreover, in the position of FIG. 20D, the motor 24 is driven to move the head holder 4 in the upward direction and to move upwards the recording head 1. Next, the cap 3 is moved to a position facing the discharge port surface, further the head holder 4 is moved downwards, and the discharge port surface 2 of each recording head is closely attached to each cap 3 to set the capping state in which the recording head is protected as shown in FIG. 4. When the capping state is returned, a series of discharge port surface cleaning operation is completed. Alternatively, depending on the situation, in preparation for the next discharge port surface cleaning, after moving upwards the recording head in the position of FIG. 20D, the wiper holder 52 is moved in the left direction to set the head cleaning standby as shown in FIG. 20A, and the apparatus may also enter a standby state while maintaining the above-described state as such.

In the eighth embodiment, the sweeping operation of the discharge port surface is executed with a top priority. In the constitution, the wiper cleaning operation, the purifying operation of the cleaning roller, the ink discharge operation from the absorbing roller and the like are omitted. According to the constitution, a comparatively inexpensive discharge port surface cleaning device is obtained. Especially, there is provided a discharge port surface cleaning device preferable for the use of a recording head having a comparatively small number of discharge ports as in the ink jet recording apparatus of a serial type in which the recording head is reciprocatingly moved in a width direction of the recording sheet to perform the recording. Even in this embodiment, the respective operations in the above-described embodiments can be appropriately combined and performed.

Ninth Embodiment

Figure 21:
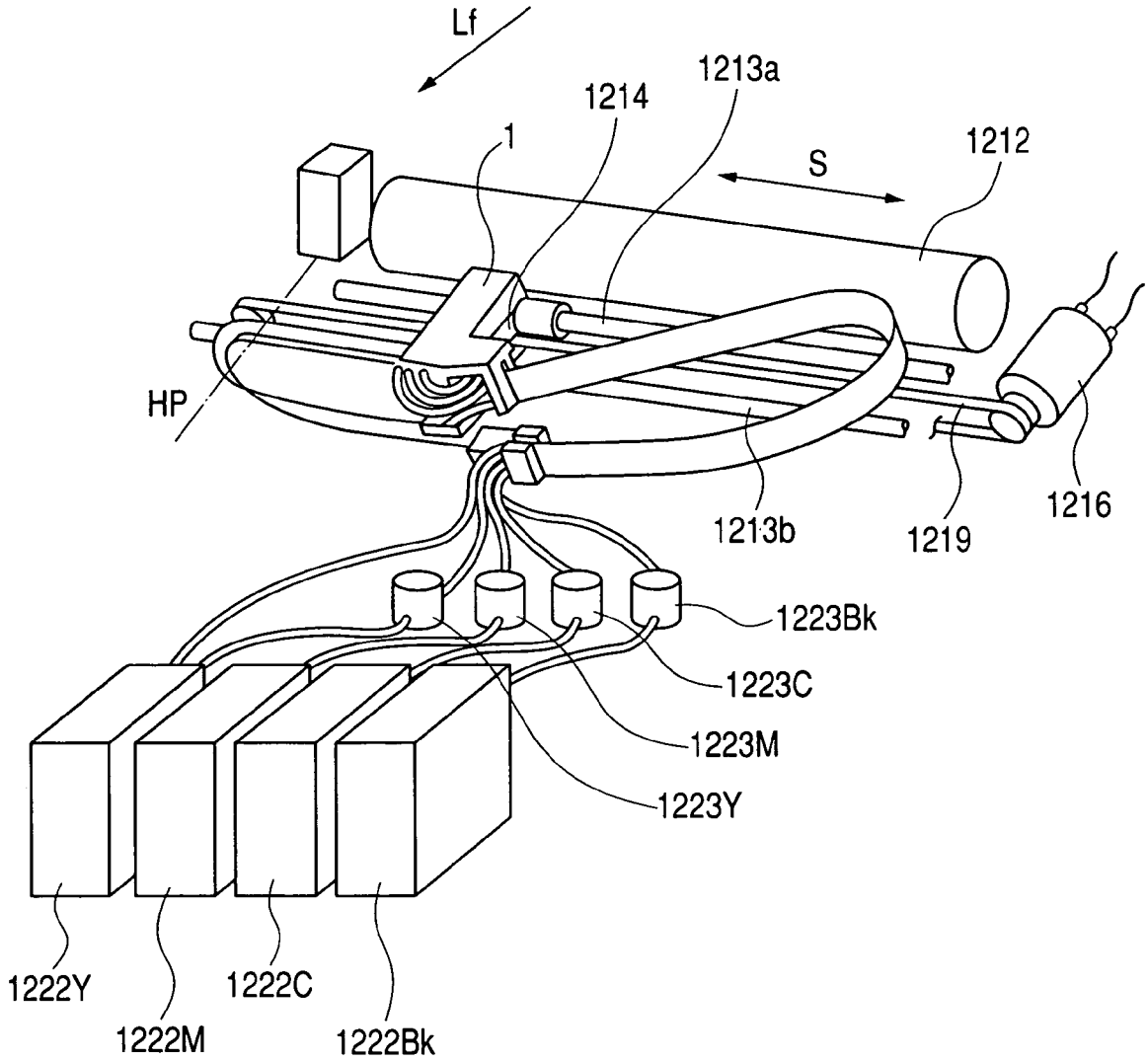
FIG. 21 is a schematic perspective view showing a schematic constitution of a ninth embodiment of the present invention.

FIG. 21 is a schematic perspective view showing a schematic constitution of a ninth embodiment of the present invention, and FIGS. 22A to 22D are explanatory views showing the discharge port surface cleaning operation of the ninth embodiment of the present invention. The present embodiment corresponds to actual application of the discharge port surface cleaning device of the eighth embodiment to an ink jet recording apparatus of a serial type.

In FIG. 21, the recording head 1 is constituted integrally with a carriage 1214 which is reciprocated/moved in an arrow S direction along guide rails 1213*a*, 1213*b*, or replaceably attached to the carriage. The recording head 1 on the carriage 1214 is reciprocated/moved in the arrow S direction (main scanning direction) via a timing belt 1219 by the driving of a motor 1216.

In FIG. 21, inks of colors stored in ink tanks 1222C, 1222M, 1222Y, 1222BK are supplied to an ink discharge section,of the corresponding color in the recording head 1 by pumps 1223C, 1223M, 1223Y, 1223BK. The recording sheet P is conveyed in an arrow f direction along a platen roller 1212, and temporarily stopped in a recording position. Then, while the recording head 1 is moved along the guide rails 1213*a*, 1213*b*, the ink is discharged onto the recording sheet from the discharge port of the recording head to record an image. When the recording for a line ends, the recording head 1 is returned to a home position. During this time, the recording sheet P is conveyed by a predetermined pitch by the platen roller 1212, and stopped in a recording position for the next line. Moreover, the recording head is moved along the guide rails to record the next line. When the operation is repeated, the recording is performed with respect to the whole recording sheet P.

Figure 22A:
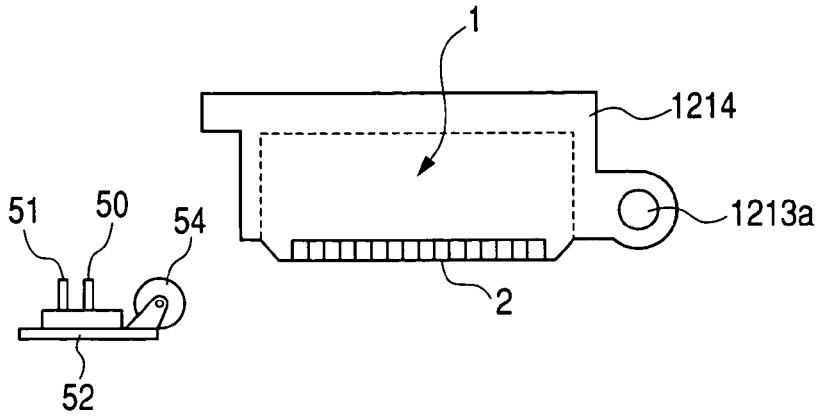
FIGS. 22A, 22B, 22C, and 22D are explanatory views showing the discharge port surface cleaning operation of the ninth embodiment of the present invention.

FIG. 22A shows a head cleaning standby state, and the wiper holder 52 is positioned on the left side of the recording head in this state as shown. Next to the standby state of FIG. 22A, an ink pressurizing operation of FIG. 22B is performed.

Figure 22B:
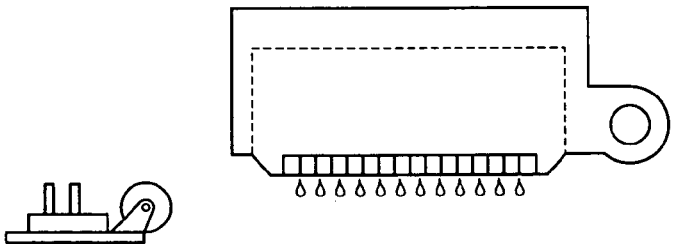

In FIG. 22B, after the ink pressurizing operation, the motor is driven to move the head holder in a shown downward direction, and the discharge port surface is set to a position where the surface can be wiped by the absorbing roller. 54 and the wipers 50, 51. Next, as shown in FIG. 20C, the wiper holder 52 is moved in the shown right direction, while the discharge port surface 2 is wiped by the absorbing roller 54 and the, wipers 50, 51. The wiping operation and the constitution for the operation in FIG. 20C are substantially the same as those in FIGS. 3F, 10C, or 20C.

Figure 22C:
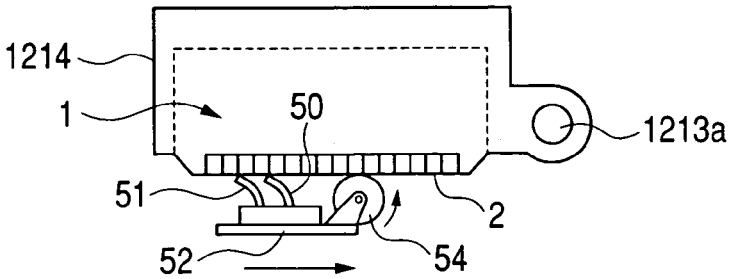
Figure 22D:
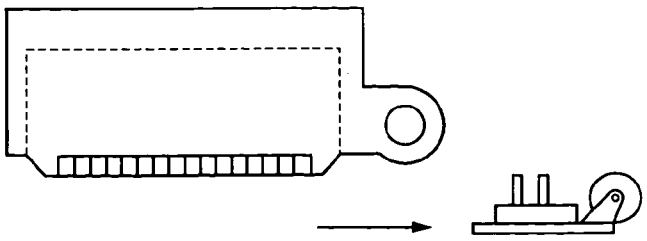

In FIGS. 22A to 22D, when the wiper holder 52 moves in the shown right direction and reaches the right side by the wiping operation of FIG. 22C, this is detected by a sensor (not shown), and the 52 is stopped in a position in the vicinity of the shown right end portion as shown in FIG. 22D. Moreover, in the position of FIG. 22D, the motor is driven to move upward the recording head. Next, the cap is moved to a position facing the discharge port surface, further the recording head is moved downwards, and the discharge port surface of the recording head is closely attached to the cap to obtain the capping state in which the recording head is protected. When the capping state is returned, a series of discharge port surface cleaning operation is completed. Alternatively, depending on the situation, in preparation for the next discharge port surface cleaning, after moving upwards the recording head in the position of FIG. 22D, the wiper holder 52 is moved in the left direction to set the head cleaning standby as shown in FIG. 22A, and the apparatus may also enter a standby state while maintaining the above-described state as such.

It is to be noted that as apparent from the above description, the present invention can be similarly applied, and similar effect can be achieved regardless of recording/scanning methods of a serial type ink jet recording apparatus which moves the recording means with respect to a material to be recorded to perform the recording, an ink jet recording apparatus of a full-line type capable of substantially simultaneously forming images in a width direction of the material to be recorded or the like. The present invention is similarly applicable to a recording apparatus using one recording means, a color recording apparatus using a plurality of recording means for recording the images in inks of different colors, a gradation recording apparatus using a plurality of recording means for recording the images in the same color with different densities, or a recording apparatus in which these apparatuses are combined, and a similar effect can be achieved.

Furthermore, the present invention is similarly applicable to any arrangement constitution of recording heads and ink tanks, such as a constitution using a replaceable ink cartridge in which recording heads are integrated with ink tanks, and a constitution in which the recording heads are constituted separately from the ink tanks, and connected to the tanks via tubes for ink supply or the like, and the similar effect can be obtained. It is to be noted that the present invention is similarly applicable to another recording system of the ink jet recording apparatus, such as a system using recording means in which an electrothermal converting member is used, a system using recording means in which electromechanical converting members such as a piezo element are used, and a system using recording means for applying electromagnetic waves such as laser to allow ink to absorb the electromagnetic waves and for discharging the ink, and the similar effect can be obtained.

According to the respective embodiments of the present invention, there is provided an ink jet recording apparatus in which foreign matter such as ink attached to a discharge port surface of recording means can be securely removed to keep the discharge port surface clean, and discharge defects of ink or deflection of an ink discharge direction can be prevented to perform satisfactory recording.

What is claimed is:

1. An ink jet recording apparatus for discharging ink from discharge ports of recording means to a material to be recorded so as to perform recording, comprising:

an ink absorbing roller for absorbing foreign matter, such as ink, attached to a discharge port surface in which the discharge ports are disposed, by rotation thereof in contact with the discharge port surface;

a wiper for wiping foreign matter, such as ink, attached to the discharge port surface;

a holder to which said ink absorbing roller and said wiper are attached, and which moves along the discharge port surface in an arrangement direction of the discharge ports; and wiper cleaning means arranged in a movement path of said holder, for wiping foreign matter attached to said wiper.

2. The apparatus according to claim 1, wherein said ink absorbing roller is formed of a porous absorbing material.

3. The apparatus according to claim 2, further comprising:

driving means for rotating/driving said ink absorbing roller.

4. The apparatus according to claim 2, wherein a one-way clutch is disposed on a rotation shaft of said ink absorbing roller.

5. The apparatus according to claim 1, wherein said ink absorbing roller is moved ahead of said wiper, when the discharge port surface is wiped by said ink absorbing roller and said wiper.

6. The apparatus according to claim 1, further comprising:

ink discharge means for discharging the ink absorbed by said ink absorbing roller.

7. The apparatus according to claim 1, wherein said wiper cleaning means is cleaned by said ink absorbing roller.

8. The apparatus according to claim 1, further comprising:

detaching means for detaching said ink absorbing roller from the discharge port surface, when said ink absorbing roller and said wiper are moved along the discharge port surface.

* * * * *

UNITED STATES PATENT AND TRADEMARK OFFICE

CERTIFICATE OF CORRECTION

PATENT NO. : 7,252,361 B2
APPLICATION NO. : 10/876465
DATED : August 7, 2007
INVENTOR(S) : Nishikawa et al.

It is certified that error appears in the above-identified patent and that said Letters Patent is hereby corrected as shown below:

COLUMN 1:
Line 45, “thicken” should read --thickened--.

COLUMN 4:
Line 65, “an” should read --of an--.

COLUMN 6:
Line 3, “is” should read --are--.
Line 7, “stand” should read --standing--.
Line 49, “side-view” should read --side view--.

COLUMN 8:
Line 51, “mechanical” should read --mechanically--.

COLUMN 9:
Line 49, “mechanical” should read --mechanically--.

COLUMN 14:
Line 36, “53;” should read --53,--.
Line 65, “embodiment-of” should read --embodiment of--.

COLUMN 16:
Line 54, “is.” should read --is--.

COLUMN 20:
Line 17, “cleaning-device,” should read --cleaning device,--.
Line 58, “effect” should read --effective--.

UNITED STATES PATENT AND TRADEMARK OFFICE

CERTIFICATE OF CORRECTION

PATENT NO. : 7,252,361 B2
APPLICATION NO. : 10/876465
DATED : August 7, 2007
INVENTOR(S) : Nishikawa et al.

It is certified that error appears in the above-identified patent and that said Letters Patent is hereby corrected as shown below:

COLUMN 21:
Line 7, "present," should read --present--.

COLUMN 24:
Line 11, "a unlocked" should read --an unlocked--.

COLUMN 26:
Line 6, "section,of" should read --section of--.
Line 30, "roller. 54" should read --roller 54--.
Line 33, "the," should read --the--.

Signed and Sealed this

Twenty-fourth Day of March, 2009

JOHN DOLL
*Acting Director of the United States Patent and Trademark Office*